United States Patent [19]

Frohlich

[11] Patent Number: 4,730,384

[45] Date of Patent: Mar. 15, 1988

[54] MACHINE FOR FASTENING A CONNECTOR TO A CABLE END BY CRIMPING

[76] Inventor: Hans Frohlich, Simoniusstr. 22, D-7988 Wangen im Allgau, Fed. Rep. of Germany

[21] Appl. No.: 800,129

[22] PCT Filed: Mar. 8, 1985

[86] PCT No.: PCT/EP85/00088

§ 371 Date: Nov. 7, 1985

§ 102(e) Date: Nov. 7, 1985

[87] PCT Pub. No.: WO85/04290

PCT Pub. Date: Sep. 26, 1985

[30] Foreign Application Priority Data

Sep. 3, 1984 [DE] Fed. Rep. of Germany ..... 3408714

[51] Int. Cl.[4] ..... H01R 43/04

[52] U.S. Cl. ..... 29/564.4; 29/565; 29/753

[58] Field of Search ..... 29/751, 753, 564.1, 29/564.4, 565, 715

[56] References Cited

U.S. PATENT DOCUMENTS

| | | | |
|---|---|---|---|
| 3,753,280 | 8/1973 | Blakency et al. | 29/564.4 X |
| 3,867,754 | 2/1975 | Koch et al. | 29/753 X |
| 3,883,938 | 5/1975 | Schmidt et al. | 29/715 |
| 3,909,900 | 10/1975 | Gudmestad | 29/564.4 |
| 3,962,780 | 6/1976 | Kindig | 29/715 X |
| 4,040,180 | 8/1977 | Brown | 29/753 |
| 4,087,908 | 5/1978 | Fusco et al. | 29/564.4 X |
| 4,178,679 | 12/1979 | Lichtenstein | 29/753 X |
| 4,489,589 | 12/1984 | Kirsinas et al. | 29/753 X |
| 4,516,309 | 5/1985 | Clark | 29/753 X |

*Primary Examiner*—Carl E. Hall

[57] ABSTRACT

Machine for providing by crimping the ends of cable conductors with end sleeves or other connection elements comprising a contact sleeve opened or closed in the envelope thereof, particularly a crimp sleeve. The machine comprises a device for feeding the end sleeves, a device for supplying the cable conductors and a crimping device cooperating with the sleeve feeding device. The crimping device is provided with a grip having jaws for the crimping of the metal tube of the end-sleeve or the contact sleeve of the connection element on the metal web of the conductor from the end of which the insulation has been removed; jaws are used to take out the synthetic collar from the end sleeve or from a portion of the connection element.

33 Claims, 49 Drawing Figures

MACHINE FOR FASTENING A CONNECTOR TO A CABLE END BY CRIMPING

The invention relates to a machine for attaching connecting elements to cable ends by crimping the connecting element to the cable.

The goal of the invention is to improve on a machine of this type, in particular to simplify it considerably.

The solution to this problem according to the invention is provided by the teaching of the characterizing clause of claim 1.

Advantageous embodiments of the invention are listed in the subclaims.

On the other hand, thus far only one device for pressing (not shown) a "tip" onto the end of a wire or a stranded connector has been published (see German Pat. No. 32 05 413-A1).

It comprises specifically:

a gripping device,
- designed to hold the stranded conductor immovably, a pressing device composed of
- a crimping arrangement with crimping chamber,
- an upstream centering arrangement with centering chamber, and
- an ejector, a stripping device and
- a "carriage body", which
- is movable in two mutually perpendicular motions and
- carries the pressing device and stripping device.

The stripping device is located in the gripping arrangement when the stranded conductor is inserted into the latter.

After the end of the stranded conductor has been stripped, the carriage body slides, causing the pressing device to move toward the gripping arrangement and, as a result of further sliding of the carriage body, onto the stripped free end of the stranded conductor, whereupon pressing takes place. Finally, the carriage body is pushed back, whereupon the ejector, with an ejector rod, pushes the end of the stranded conductor with the tip pressed in place, out of the crimping chamber and the centering chamber.

While in this known embodiment the feed of the "tips" to the centering arrangement and the crimping arrangement as well as the design of the stripping arrangement are left completely open, the following design is disclosed exclusively for the centering arrangement and the crimping arrangement (both in the claims and in the description of the figures):

the movable crimping chamber which receives the "tips" is reducible in its cross section for squeezing the "tips" by
- four segmental bodies in the shape of straight prisms, which
- are so arranged around the square crimping chamber that one lateral face of each segmental body forms a side wall of the crimping chamber, and
- are displaceably guided along a straight line in a cross-sectional plane which is perpendicular to the lengthwise axis of the segmental bodies, and the centering arrangement for feeding the end of the wire or the stranded conductor into the "tip" located in the crimping chamber comprises accordingly:

- upstream of the crimping chamber, four segmental bodies in the shape of straight prisms, in the insertion direction of the wire or stranded conductor,
- which are so disposed about the centering chamber that one lateral surface of each segmental body forms a lateral wall of the centering chamber, and
- are displaceably guided along a straight line in a cross-sectional plane perpendicular to the lengthwise axis of the segmental bodies and whereby the centering chamber, in the closed position, on the insertion side of the wire or stranded conductor, comprises a frustroconical segment tapering from the insertion opening to the interior of the centering chamber, and a circularly cylindrical segment adjacent thereto, extending over the remaining length of the centering chamber, and whereby the centering arrangement is intended to ensure, especially by virtue of its frustroconical segment, a reliable insertion of the end of the stranded conductor in the stripped state, even if individual strands of the stranded conductor project laterally from the lengthwise axis of the end of the stranded conductor.

In this connection, an automatic "tip mounting machine" for (exclusively) 1.5 mm×10 mm tips, DIN 46 218 on 1.5 mm NYAF wire with the following features has been disclosed (trade name: "Klemmfix 2001" made by the Weiszhar Co.):

Stripping arrangement:

Two knives and a stop, by which the depth of cut can be set precisely, so that the stranded conductor is not damaged during stripping:

Tip feeding arrangement:

By means of a "tip strip"(tip belt) wound on a magazine disk, automatic feed of lead tips to a feed funnel;

Pressing arrangement:

Four-edge pressing is provided by a toggle lever and constant spring pressure to produce a constant crimping result:

Motion control:

Drive with magnetic clutch and brake, as well as "hardened curves".

Disadvantages of this known state of the art include in particular:

unavoidable, costly belting of lead tips,
- which considerably endangers the desired time savings by automatic stripping, owing to the required manual labor (which would be equivalent to the "tedious threading of the lead tips" which is to be avoided),
- quite apart from the additional preparation of belted material, which also is left over as waste,
- finally, also makes storage more difficult, and
- makes the entire device much more bulky owing to the considerable dimensions of the tip belt magazine disk;

a separate costly centering arrangement for reliable feeding of the stripped ends of the stranded conductor;

costly, problem-prone design of the crimping arrangement, especially due to the numerous segmental bodies and their mountings;

separate ejector (of the crimping arrangement), which increases the cost and trouble-proneness of the entire device;

control in the form of "hardened curves" that is not operationally reliable and is relatively slow to respond;

difficult, in any case very limited or completely impossible, adjustability of the device for different tip dimensions;

thus, the "Klemmfix 2001" is designed only for a very specific wire (1.5 mm NYAF) and a very specific tip (1.5 mm×10 mm DIN 46 218), considerably limiting its use in operational practice;

no constant crimping quality owing to the toggle lever-spring-drive of the crimping arrangement, and therefore possible aging of the springs.

Moreover, numerous machines for equipping cable lead ends with previously specifically belted crimp contact elements by crimping are known, which therefore must be fed and processed in an expensive belt form, have been known for a long time (see for example U.S. Pat. No. 3,376,627).

The invention is described in greater detail with reference to the drawings.

FIG. 1 is a first embodiment of the machine according to the invention in schematic (not to scale) (diagonal) top view;

FIG. 1*a* is a (considerably enlarged) section through a lead tip, crimped on a cable lead end;

Figure 4:
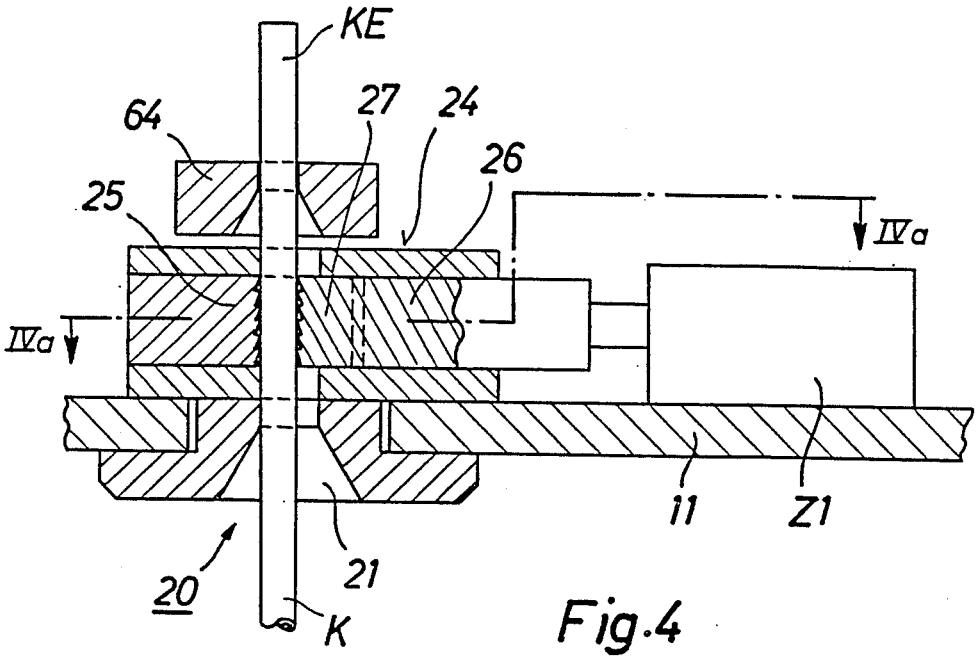
FIG. 4 is a lengthwise section through a cable lead gripping arrangement as a single-punch chuck.
Figure 4A:
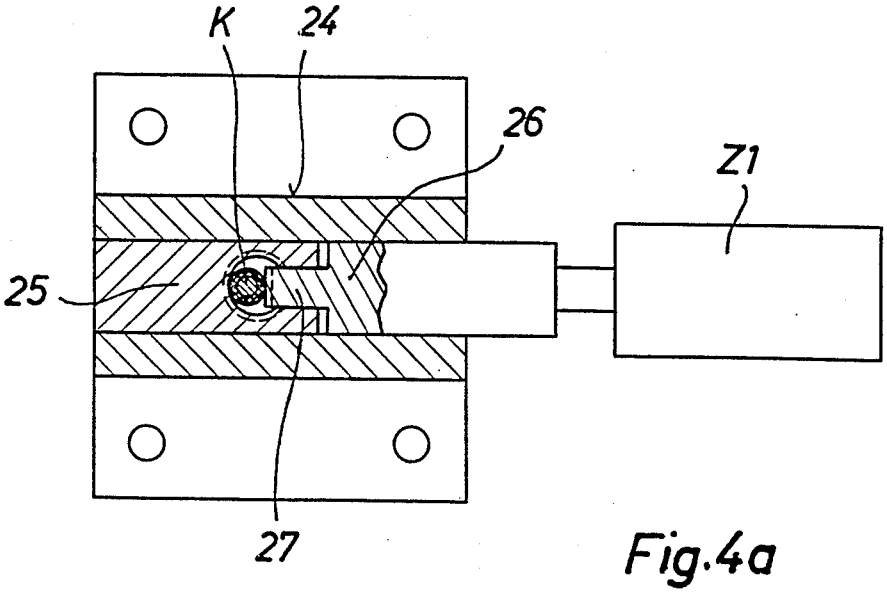
Figure 5:
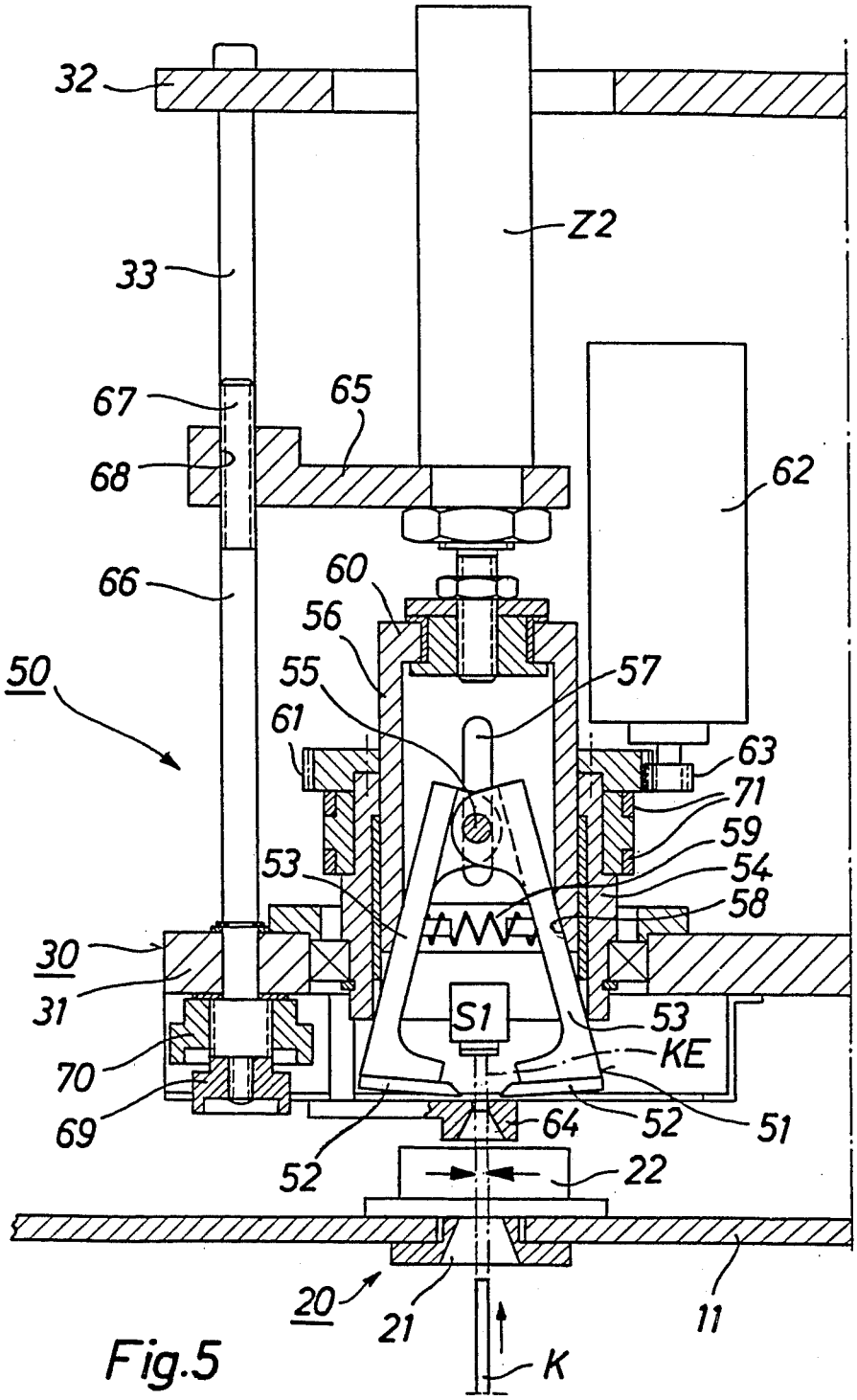

FIG. 4*a* is a section along line IV*a*—IV*a* in FIG. 4;

FIG. 5 is an axial section through a stripping arrangement to strip the cable lead end, positioned at the cable lead inlet shown in FIGS. 4 and 4*a;*

Figure 2:
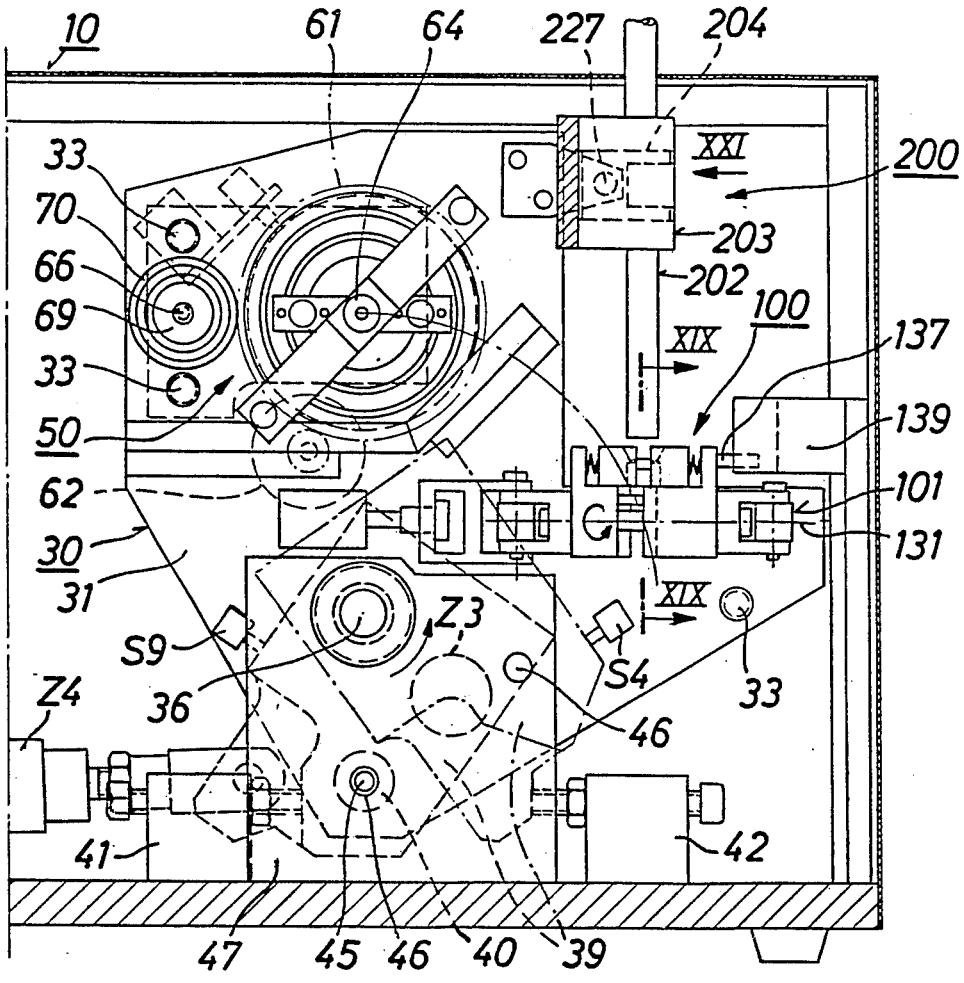
FIG. 2 is an embodiment of the machine shown in FIG. 1, to scale, in the section along line II—II.
Figure 6:
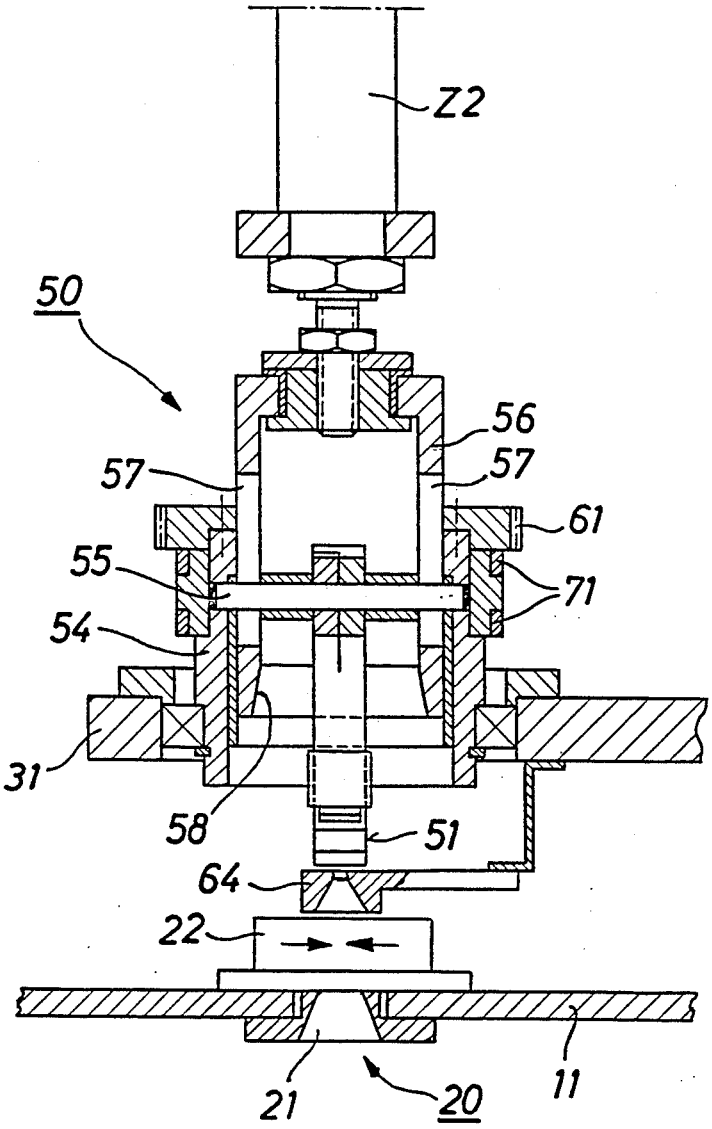
Figure 8:
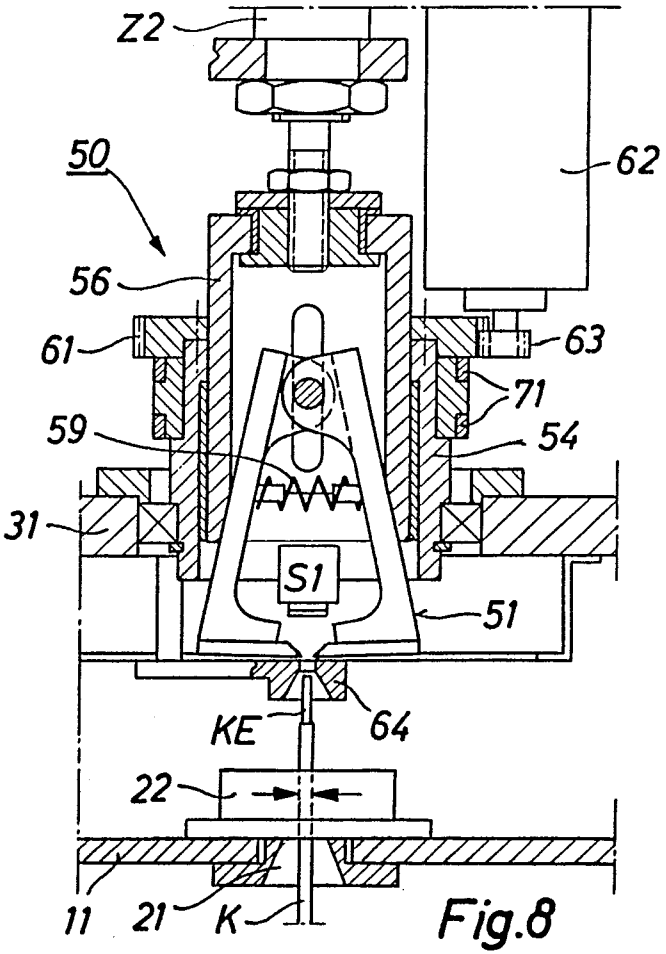
Figure 7:
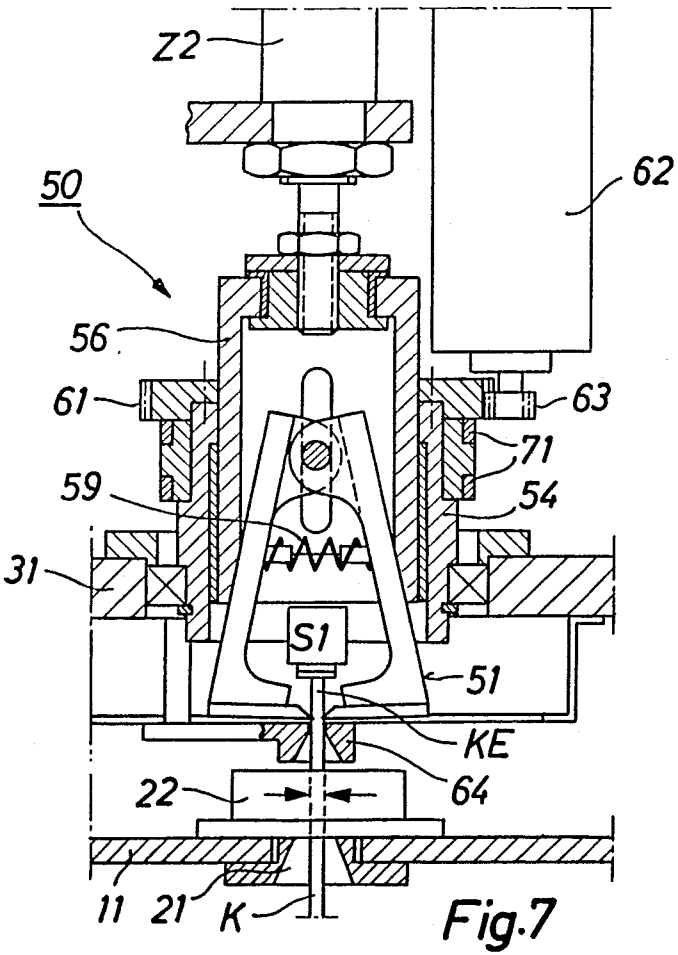
Figure 9:
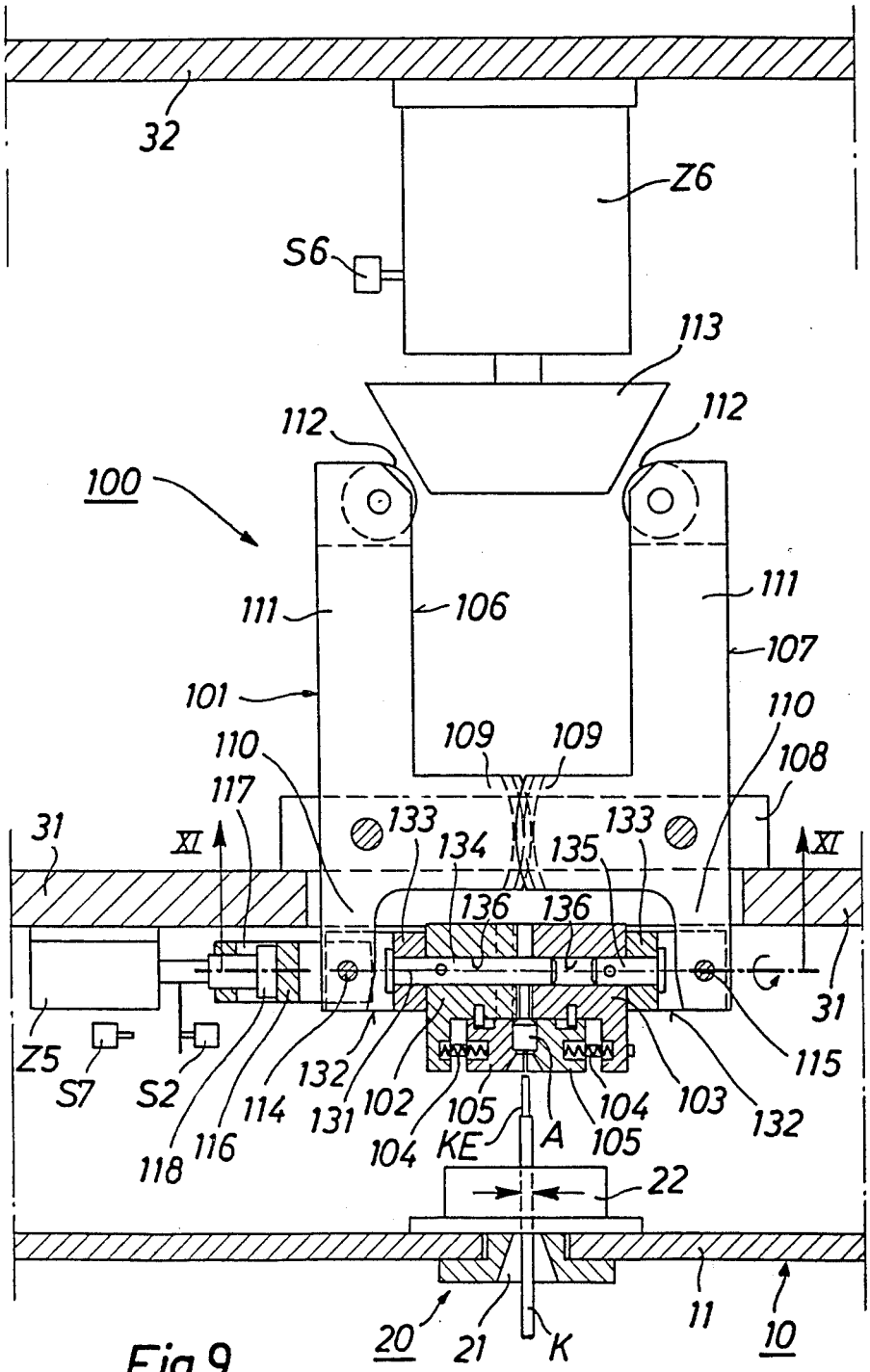
Figure 10:
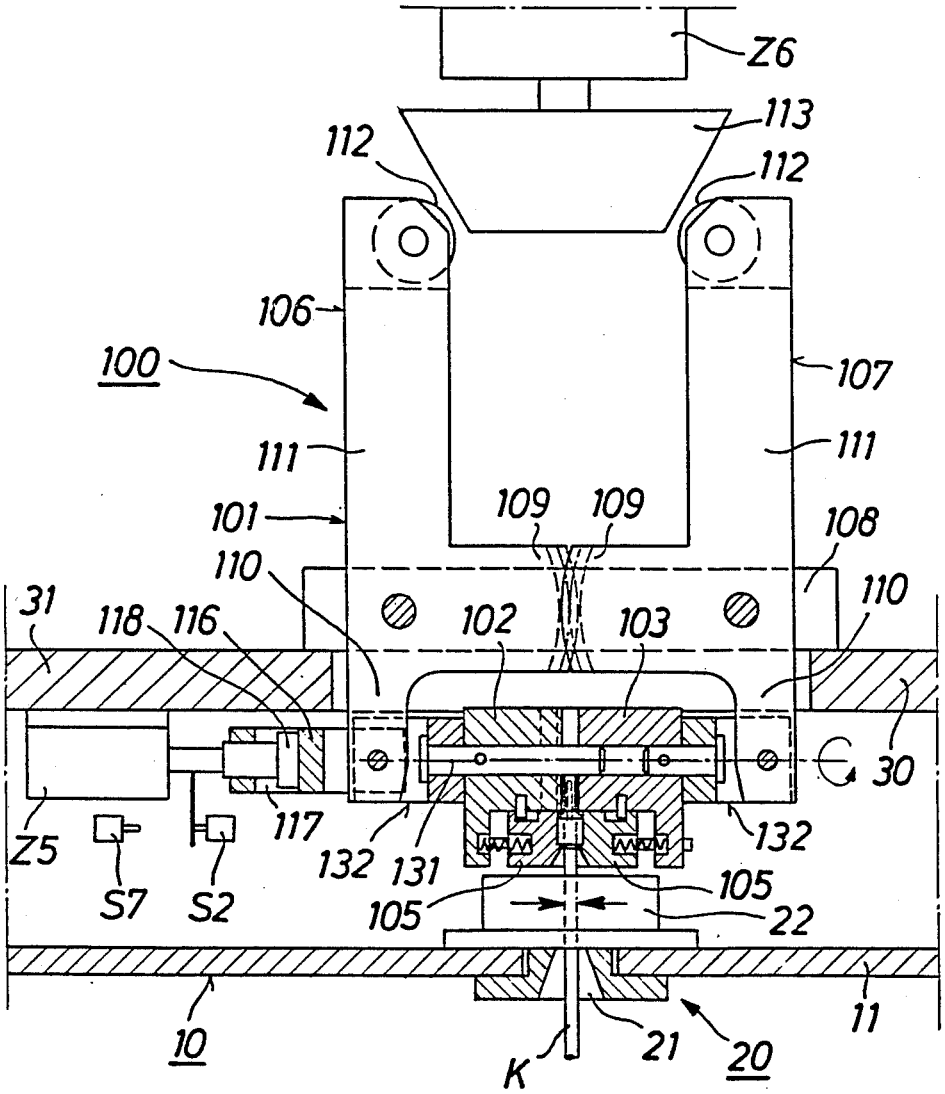
Figure 11:
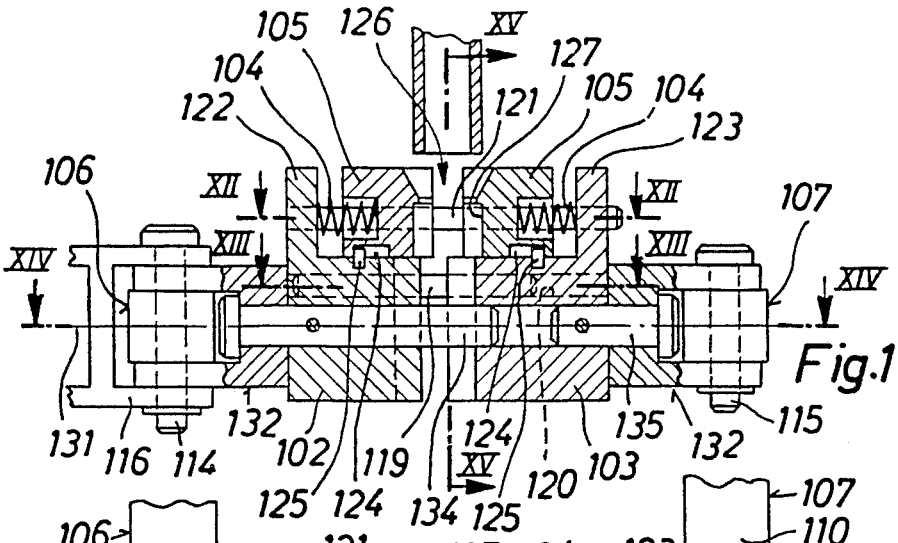
Figure 12:
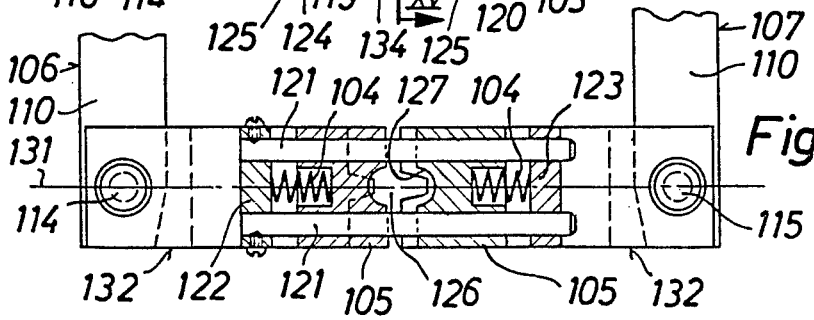
Figure 13:
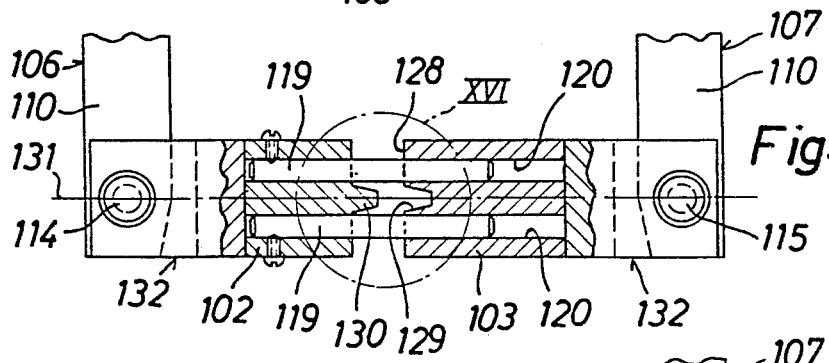
Figure 14:
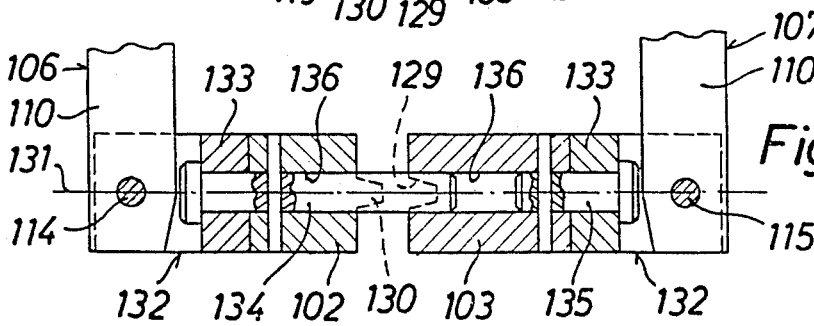
Figure 15:
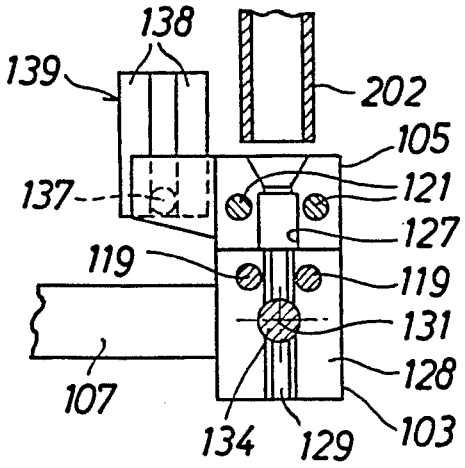
Figure 16:
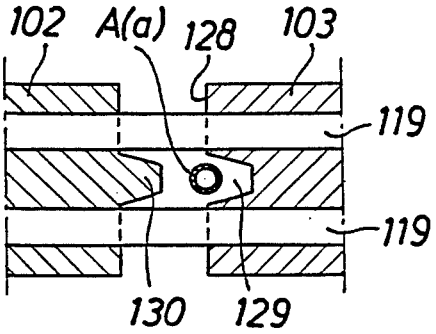
Figure 17:
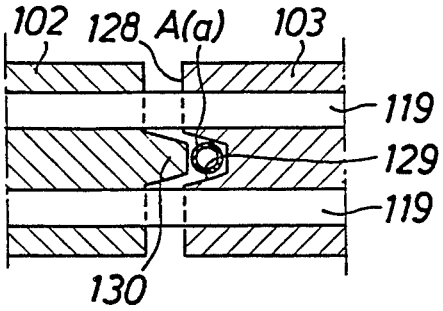
Figure 18:
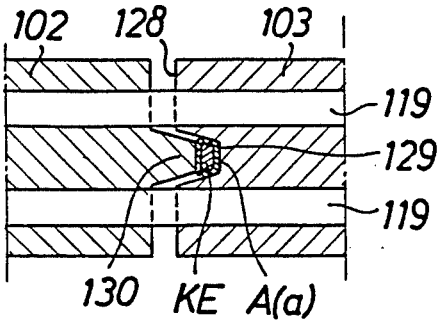
Figure 19:
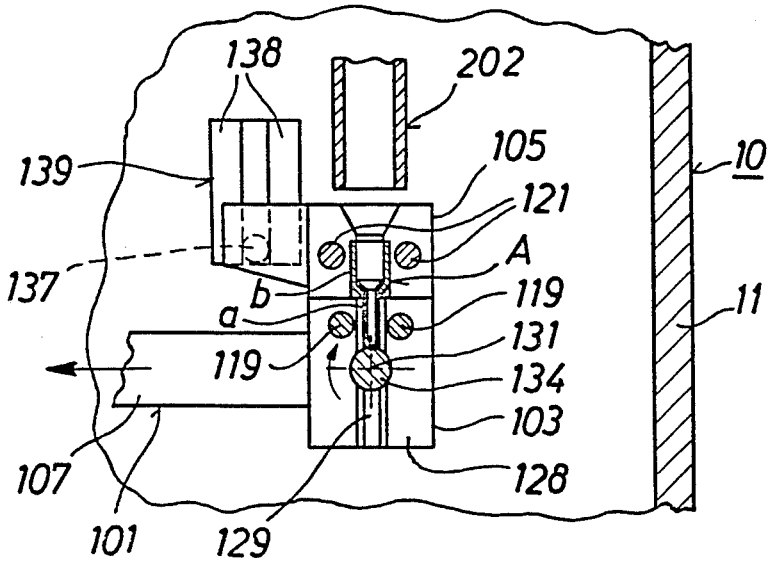
Figure 20:
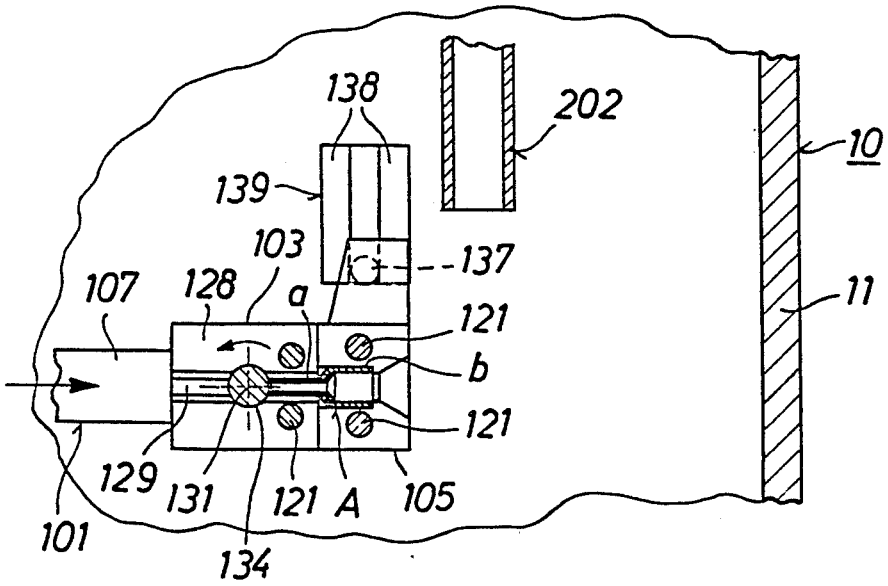
Figure 22:
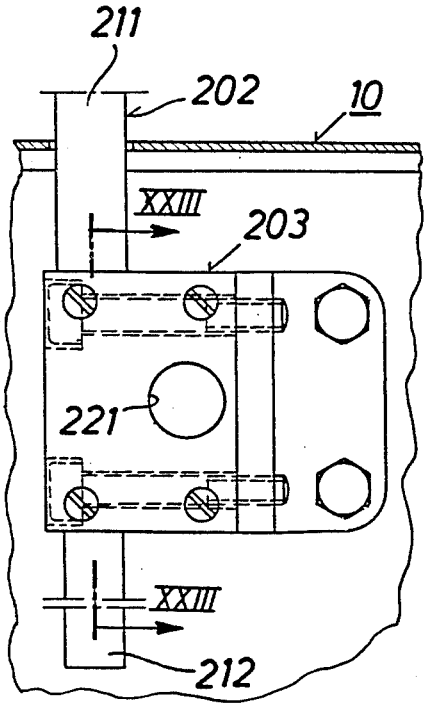
Figure 21:
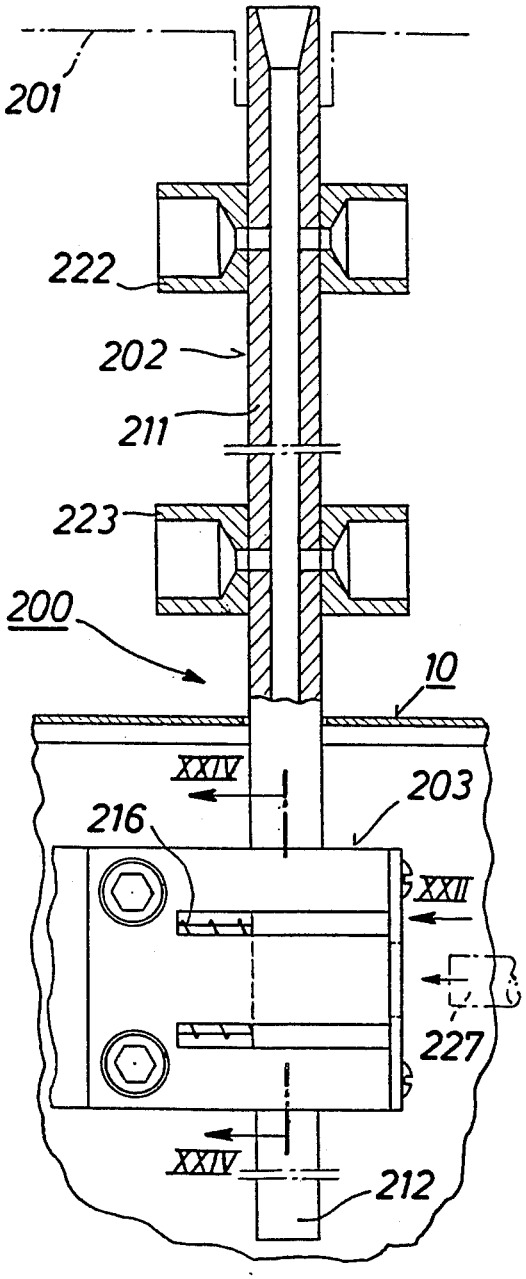
Figure 24:
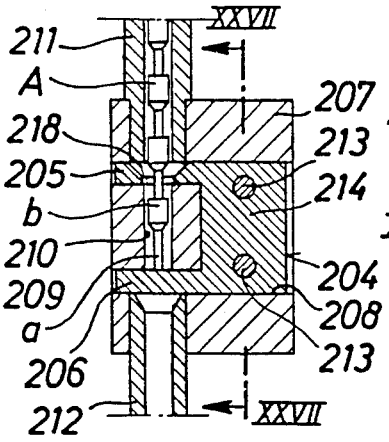
Figure 23:
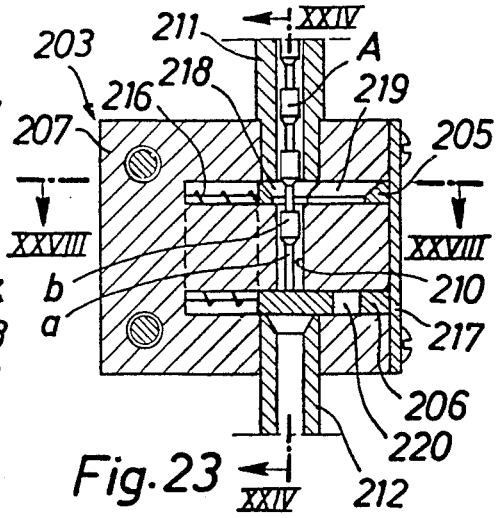
Figure 26:
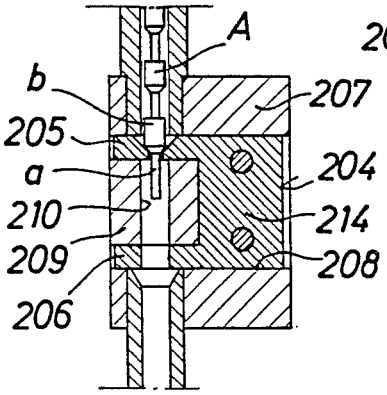
Figure 25:
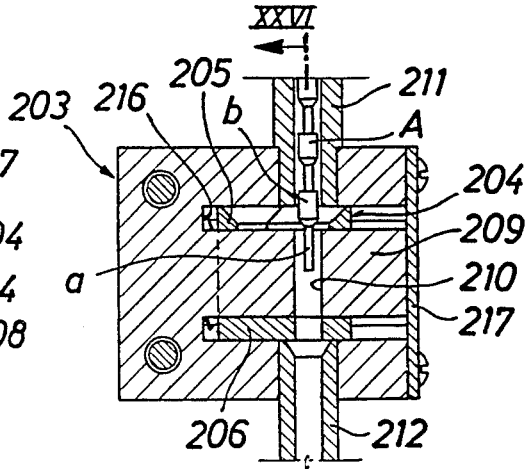
Figure 27:
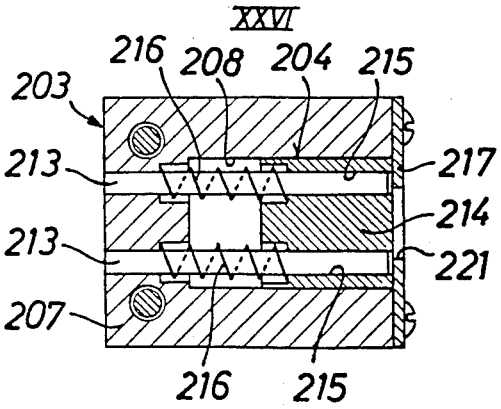
Figure 28:
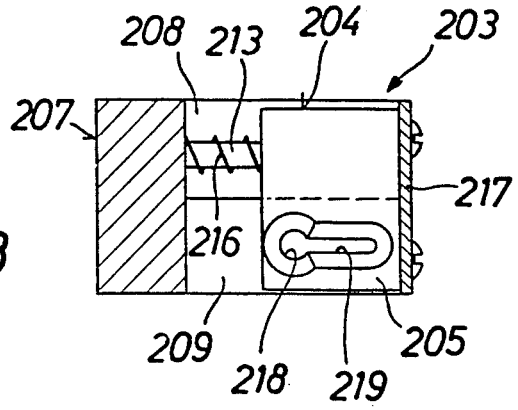
Figure 29:
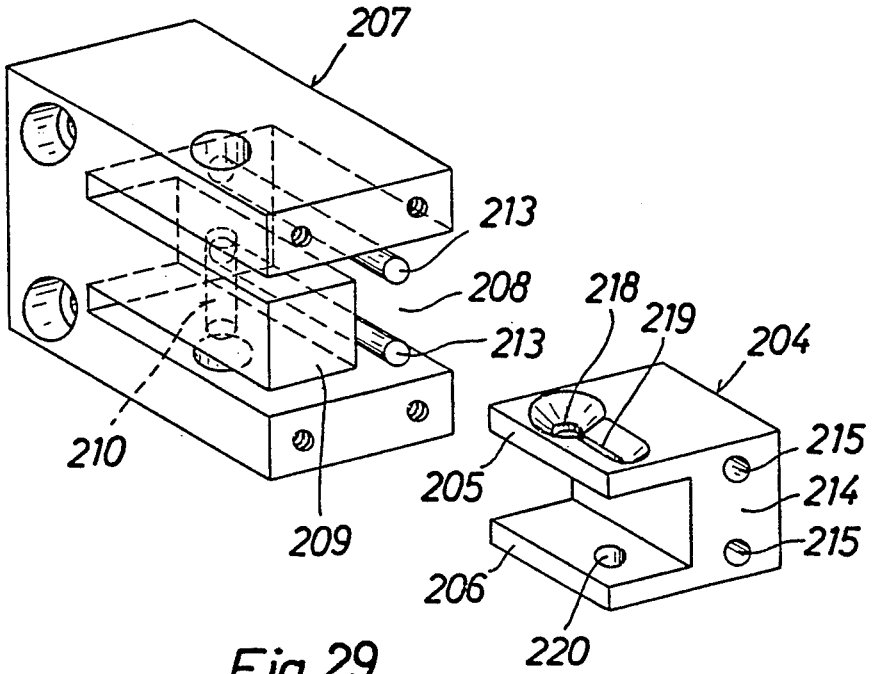
Figure 30:
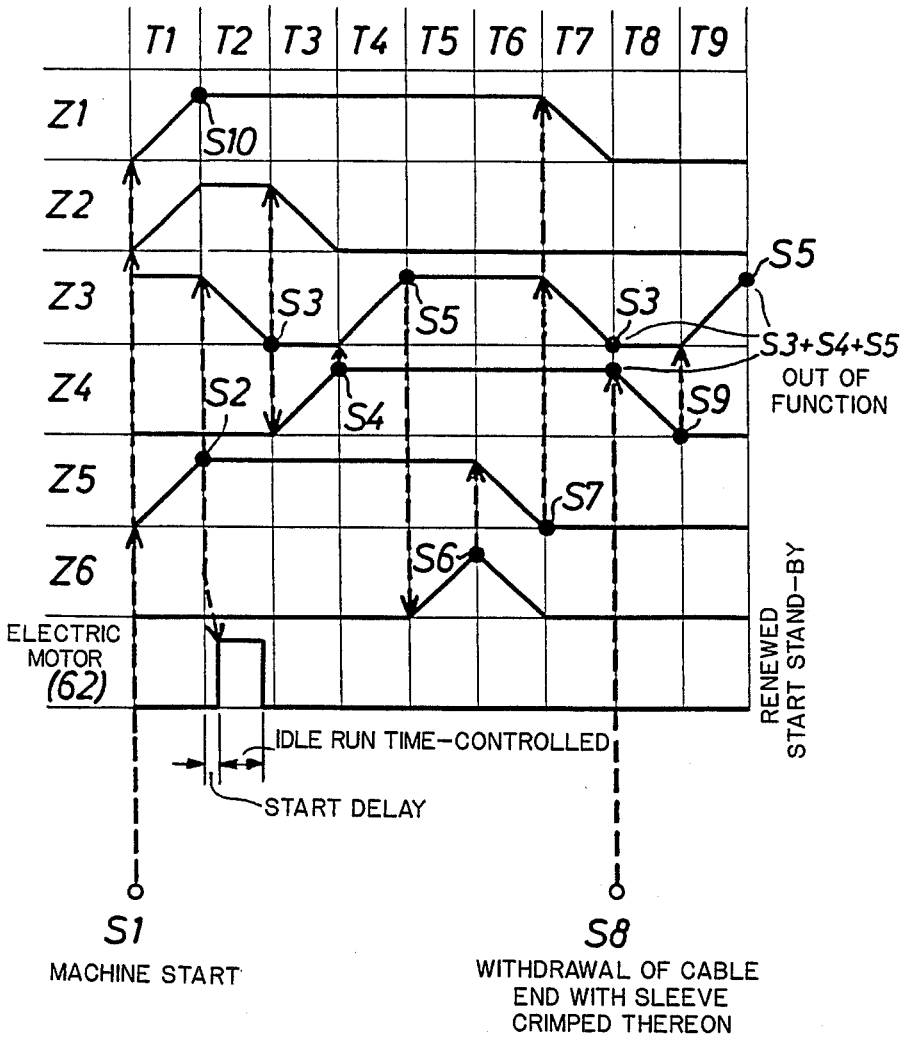
Figure 31:
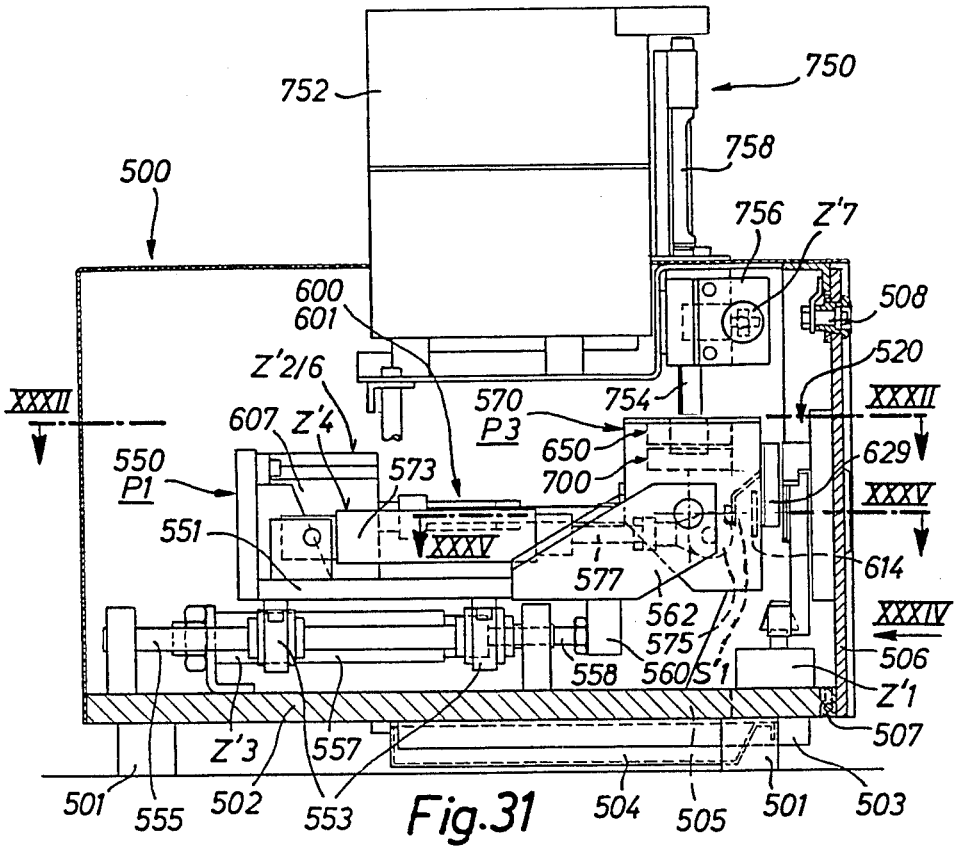
Figure 32:
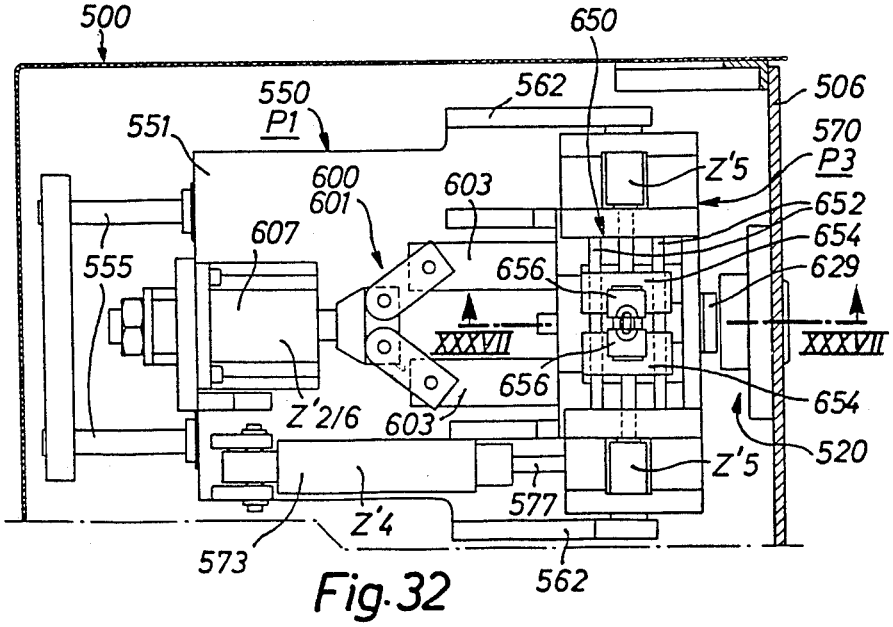
Figure 33A:
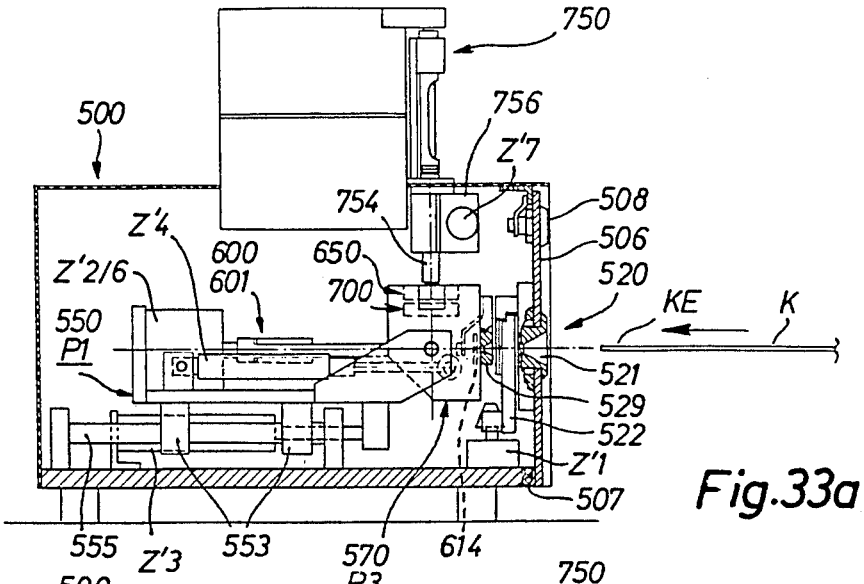
Figure 33B:
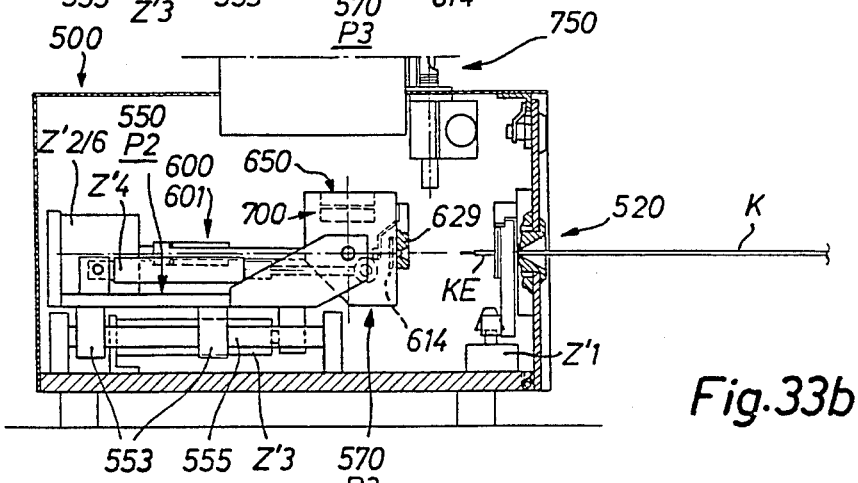
Figure 33C:
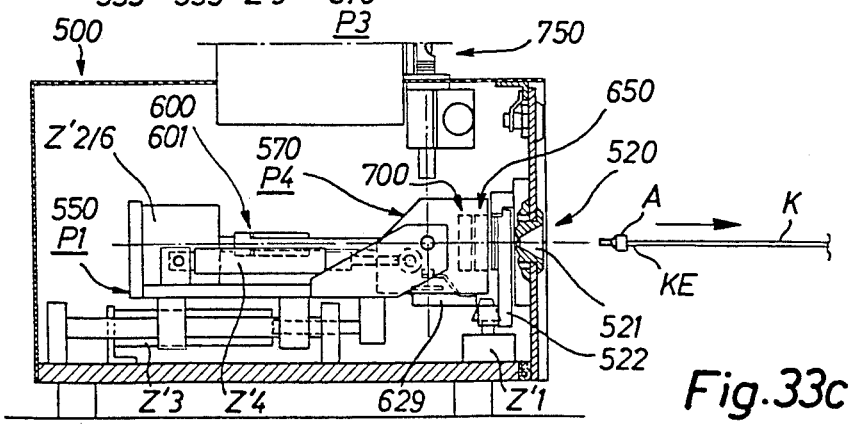
Figure 34:
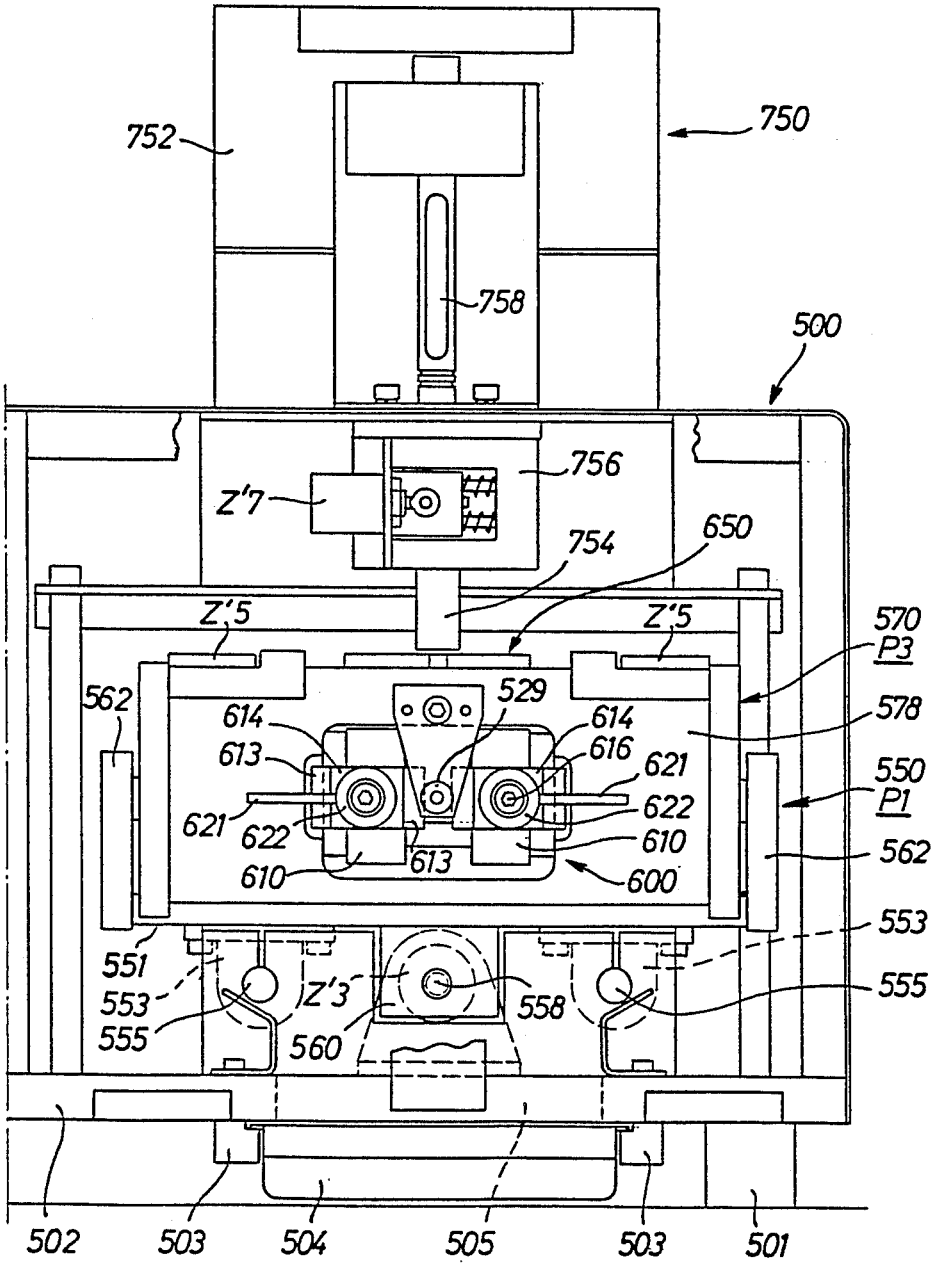
Figure 35:
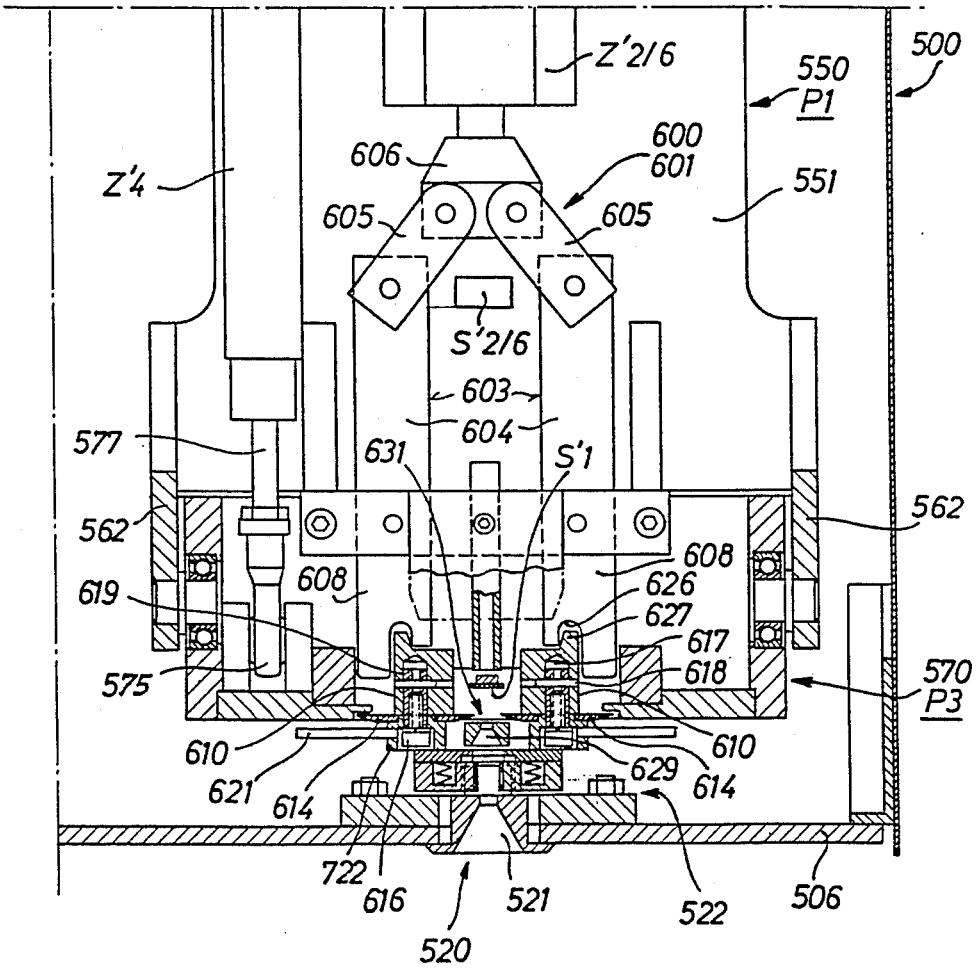
Figure 36:
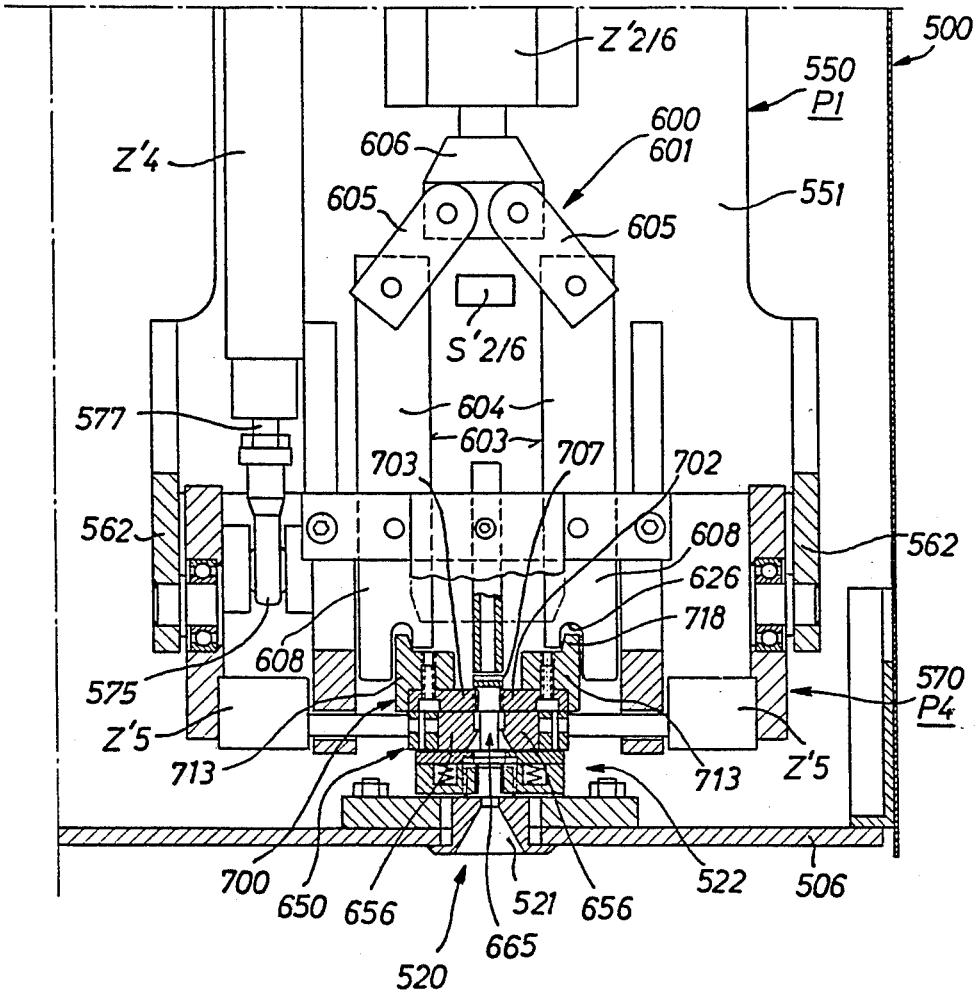

FIG. 6 is an axial section, rotated through 90°, of the stripping arrangement shown in FIG. 5;

FIG. 7 is the stripping arrangement shown in FIG. 5, showing the stripper gripper closed before stripping;

FIG. 8 is the stripping device shown in FIG. 5, shortly before completion of stripping;

FIG. 9 is an axial section through a crimping arrangement for crimping a cable tip on the stripped cable lead end, positioned at the cable lead inlet;

FIG. 10 is the crimping arrangement shown in FIG. 9 in another working position;

FIG. 11 is a section along line XI—XI in FIG. 9 of the crimping arrangement for receiving a lead tip, positioned with the receiving opening open at the opening of a vertical lead tip feed chute;

FIG. 12 is a section along XII—XII in FIG. 11;

FIG. 13 is a section along XIII—XIII in FIG. 11;

FIG. 14 is a section along XIV—XIV in FIG. 11;

FIG. 15 is a section along XV—XV in FIG. 11;

FIG. 16 is an enlarged section XVI of FIG. 13 showing the reception of the metal tubular part of a lead tip between the crimping jaws with the lead tip gripper open;

FIG. 17 corresponding to FIG. 16, with the gripper jaws and the lead tip gripper in the tensioned position;

FIG. 18 corresponding to FIG. 16, with the crimping jaws, after the metal tubular part of the lead tip has been crimped onto the stripped cable lead end;

FIGS. 19, 20, each showing a section along XIX—XIX in FIG. 2, with the swing-slide frame in a first end swing position and in a second as well as first end slide position, as a tilting adjustment of the lead tip gripper around the axis in the direction of motion of the gripper jaws takes place during the steering of the swing-slide frame from the first end slide position to the second end slide position and vice versa;

FIG. 21, shown enlarged, a lead tip feed arrangement, feeding the crimping arrangement, looking in the direction of arrow XXI in FIG. 2, with the lead tip supply container indicated by the dot-dashed line and the lead tip feed chute connected at the top;

FIG. 22, looking in the direction of arrow XXII in FIG. 21, side view of lead tip feed arrangement;

FIG. 23, section XXIII in FIG. 22, of a lead tip sorting arrangement for the lead tip feed arrangement with lead tips stored in the resting position;

FIG. 24 is a section along XXIV—XXIV in FIG. 23;

FIG. 25 is a section according to FIG. 23 through the lead tip sorting arrangement in the actuation position;

FIG. 26 is a section along XXVI—XXVI in FIG. 25;

FIG. 27 is a section along XXVII—XXVII in FIG. 24;

FIG. 28 is a section along XXVIII—XXVIII in FIG. 23;

FIG. 29 is a perspective view of the slide and slide guide of the lead tip sorting arrangement;

FIG. 30 is an automatic operating flowchart of the first embodiment of the machine;

FIG. 31 is a *second* embodiment of the machine according to the invention shown in a side view, with the housing cut away;

FIG. 32 is a section along XXXII—XXXII in FIG. 31;

FIG. 33*a, b, c* corresponds to FIG. 31, but on a reduced scale and showing in simplified form three successive operating positions;

FIG. 34, an enlarged view along XXXIV of FIG. 31, with the front wall of the housing removed;

FIG. 35, an enlarged section along XXXV—XXXV in FIG. 31;

FIG. 36, FIG. 35 corresponding to operating position shown in FIG. 33*c;*

Figure 37:
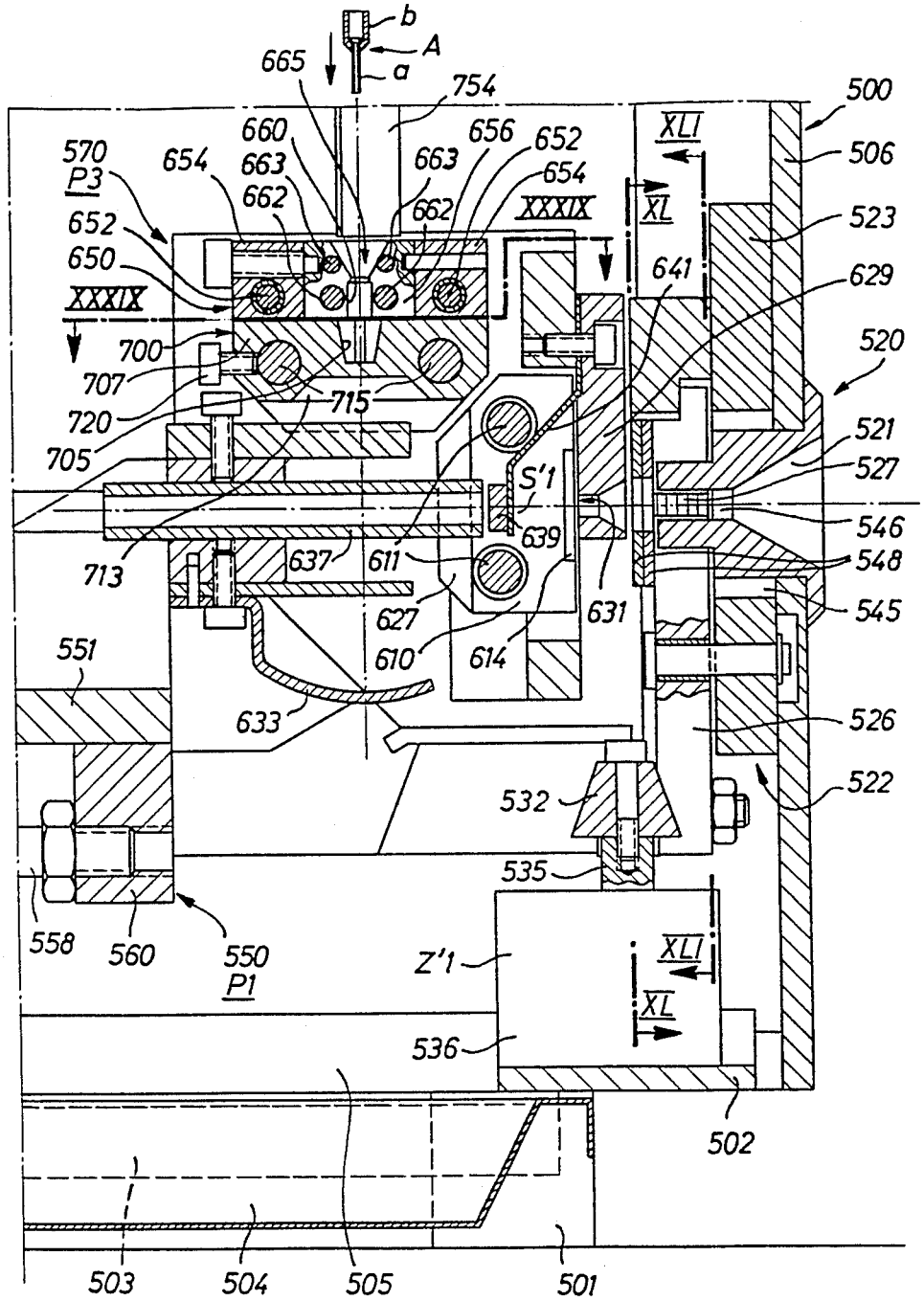
Figure 38:
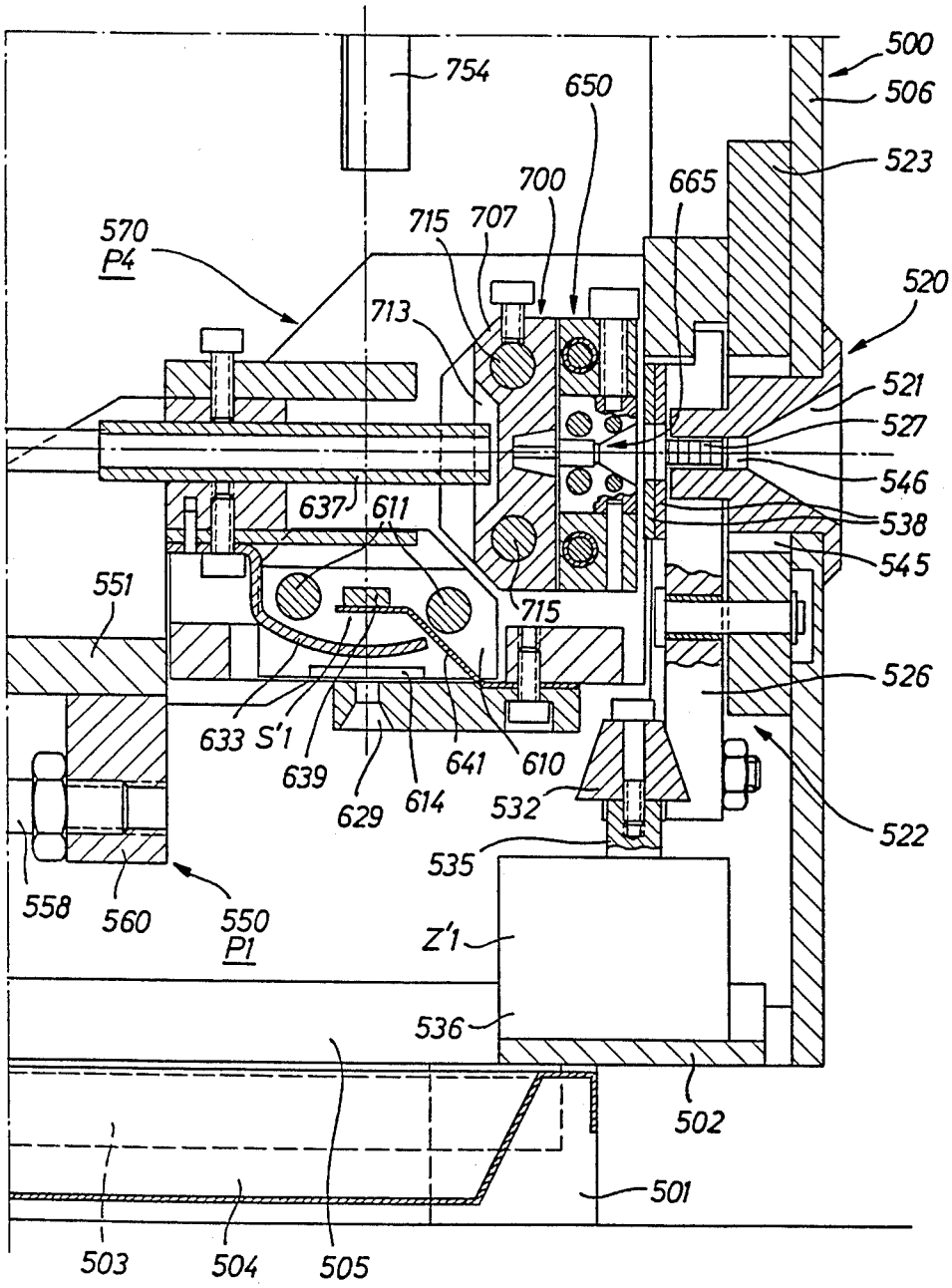

FIG. 37, a section along XXXVII in FIG. 32 enlarged relative to FIGS. 35 and 36;

FIG. 38 shows FIG. 37 corresponding to the operating position of FIG. 33*c;*

Figure 39:
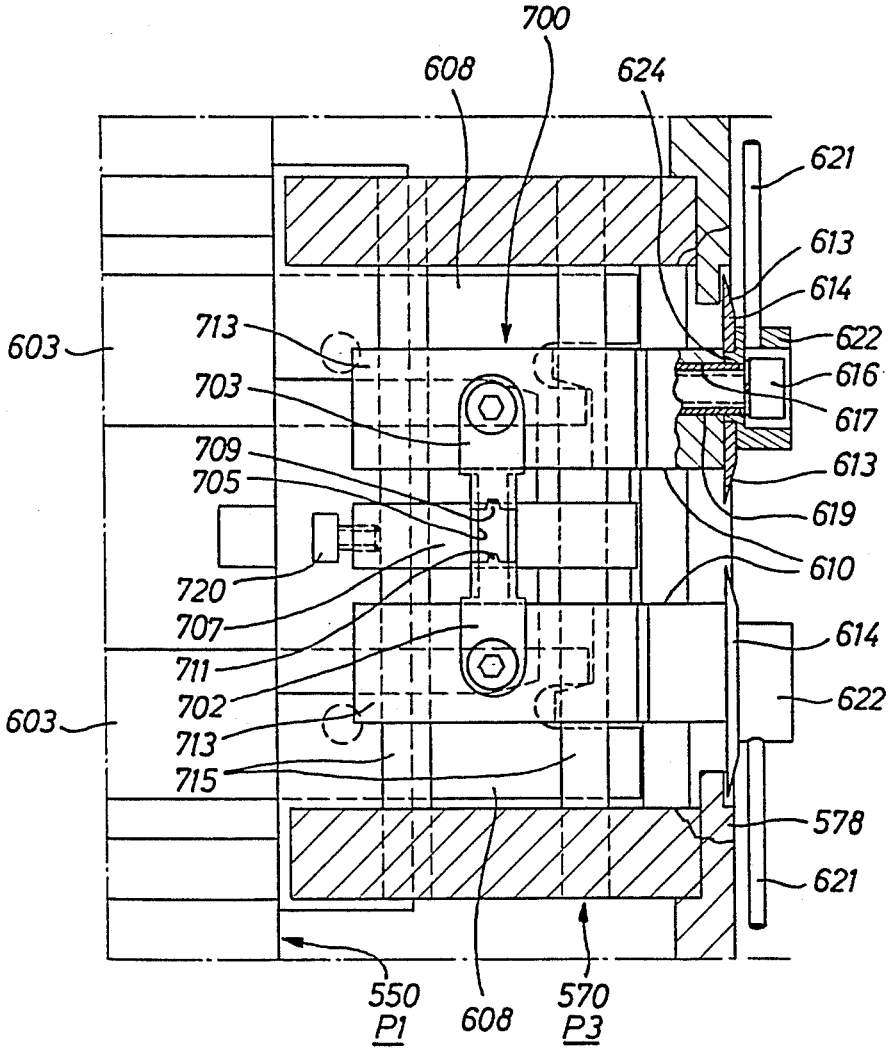
Figure 40:
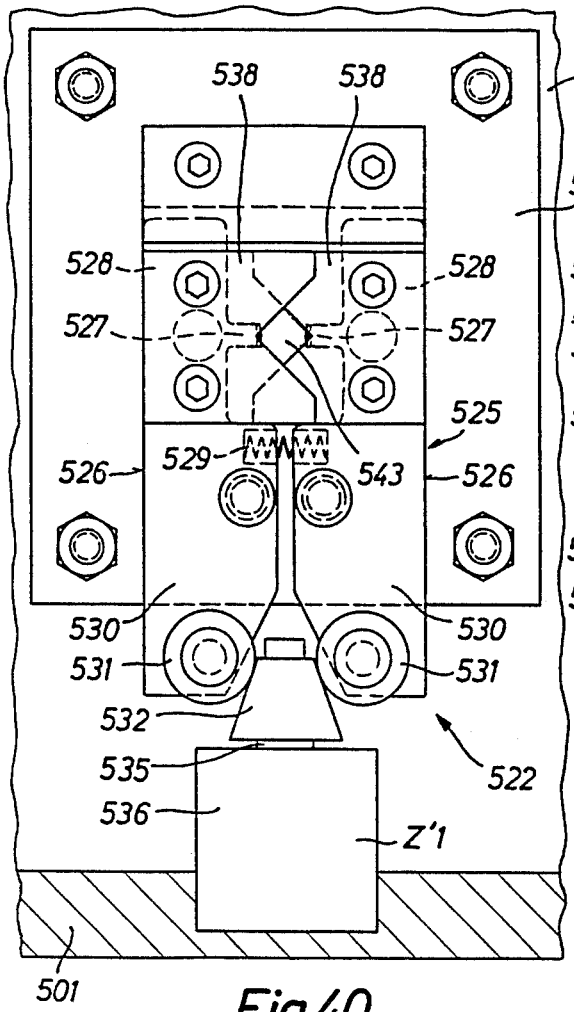
Figure 41:
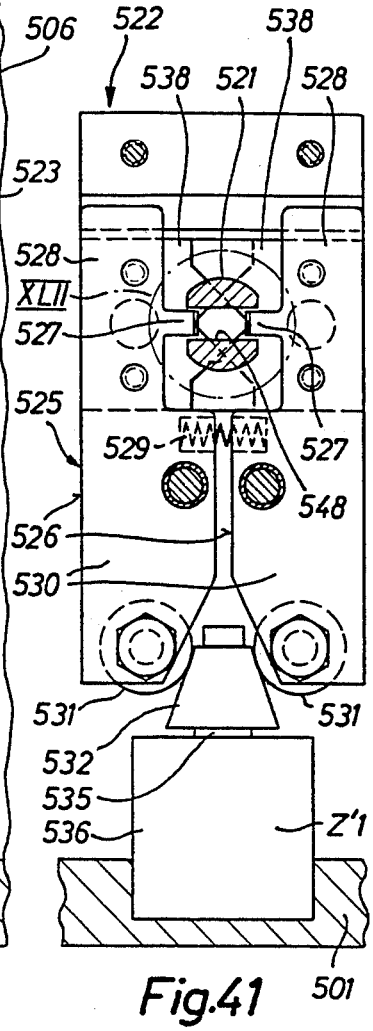
Figure 42A:
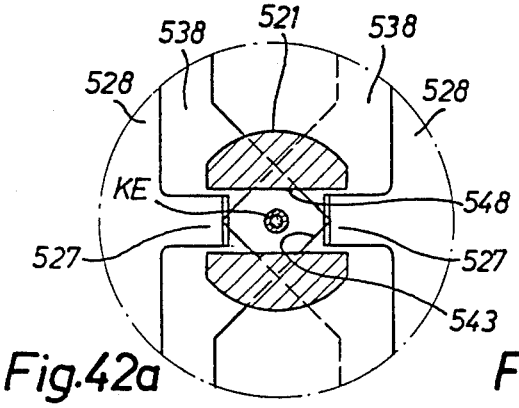
Figure 42B:
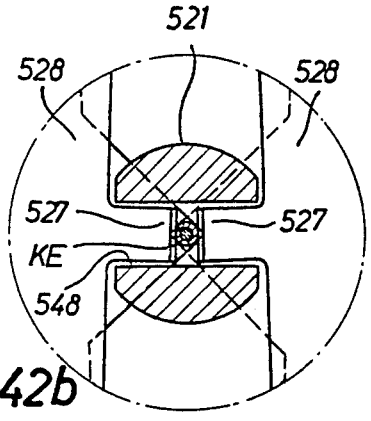
Figure 43:
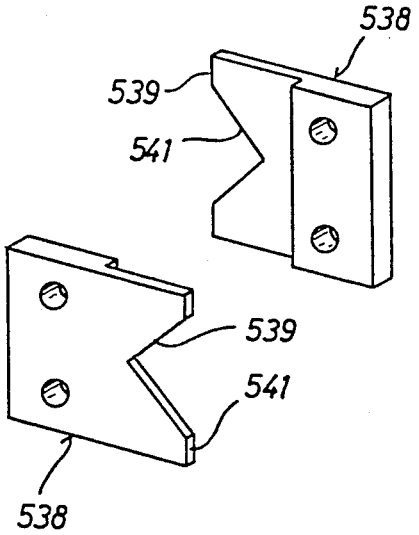
Figure 44:
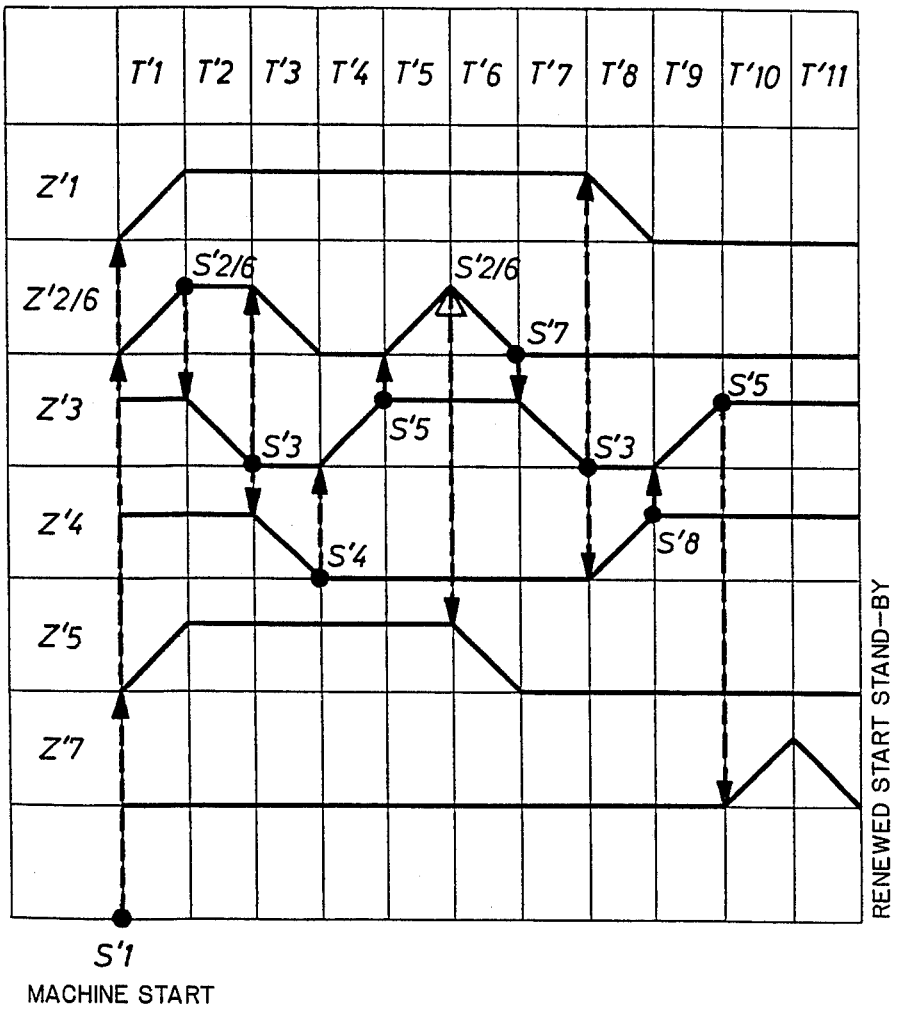

FIG. 39 is a section along XXXIX—XXXIX in FIG. 37;

FIG. 40 is a section along XL—XL in FIG. 37;

FIG. 41 is a section along XLI—XLI in FIG. 37;

FIG. 42*a, b* is an enlarged section XLII of FIG. 41 of the cable lead gripping arrangement out of and in the cable lead gripping position;

FIG. 43 shows in perspective view, individually, the centering plates of the cable lead gripping arrangement; and FIG. 44 shows an automatic operating flowchart for the second embodiment of the machine.

Figure 1:
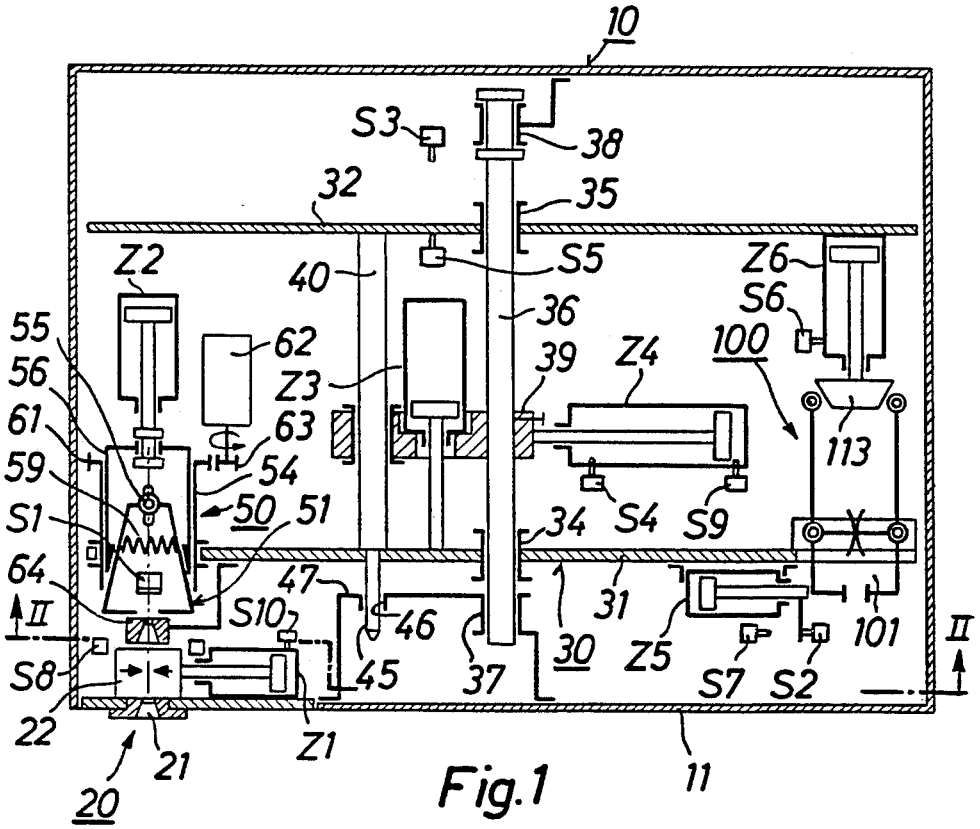
Figure 1A:
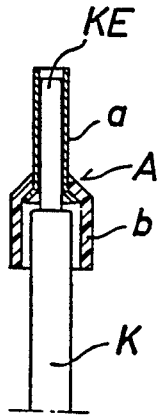

FIGS. 1–30 show a first embodiment of the machine according to the invention for stripping a cable lead K at cable lead end KE and providing it with a lead tip A shown in FIG. 1*a*, by crimping, said tip being made of a metallic tubular part a and a conically attached plastic collar b.

According to schematic FIG. 1, this machine comprises the following:

a machine housing 10;

a cable lead inlet 20 on the front wall of housing 10;

a swing-slide frame 30 in housing 10;

a stripping arrangement 50 for stripping cable lead end KE, whose stripping tool 51 is supported by swing-slide frame 30 and is therefore swingable and movable with respect to cable lead inlet 20;

a crimping arrangement 100 for providing the stripped cable lead end KE with lead tip A and then crimping it, likewise supported by swing-slide frame 30, and thereby swingable alternately with striping device 50 with respect to cable lead inlet 20;

a fixed cable tip feed arrangement 200 (see FIG. 2) with a cable tip sorting arrangement 203, which supplies crimping arrangement 100.

Cable lead inlet 20:

According to FIGS. 1, 4, and 4*a* in particular, it is provided with a feed funnel 21 on a horizontal axis, externally on housing front wall 11, and behind this, a cable lead gripping arrangement 22 located inside on the same housing front wall 11, controlled by a pneumatic cable lead gripping pressure cylinder Z1. Cable lead gripping arrangement 22, as shown schematically, can be for example by a multi-jaw radial chuck or a chuck 24 with a gripping punch 26 operating against a fixed gripping counterbearing 25, with a toothed gripping nose 27, as shown in FIG. 4, 4*a*.

Figure 3:
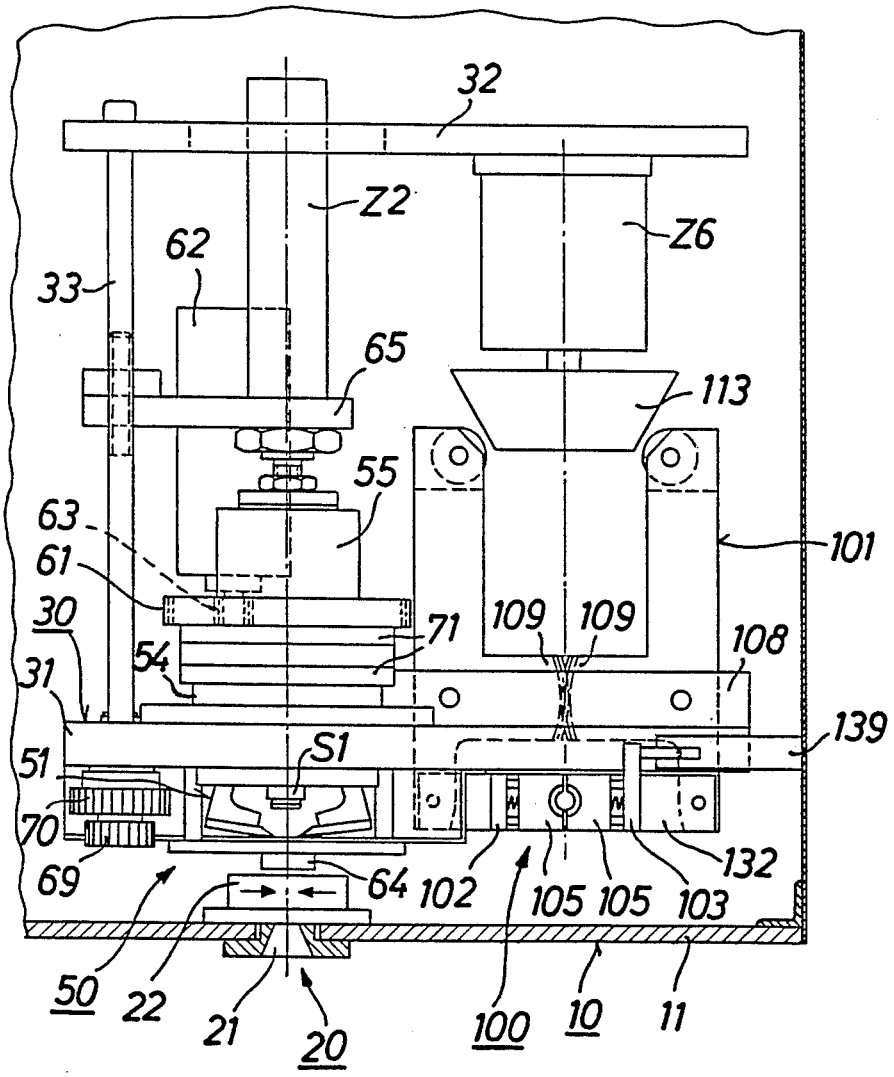
FIG. 3 is a top view of the machine shown in FIG. 2.

Swing-Slide Frame 30:

According to FIGS. 1–3 in particular, it is swingable parallel to the axis of cable lead inlet 20 by means of a horizontal shaft 36 between two end swing positions for positioning either the stripper arrangement 50 or crimping arrangement 100 at cable lead inlet 20, as well as displaceably in the axial direction of shaft 36 for actuating stripping arrangement 50.

Swing-slide frame 30, specifically, as shown in FIGS. 1–3 and 5, has a front panel 31 adjacent to housing front wall 11 and a rear panel 32 which, as shown in FIGS. 2, 3, and 5, are connected together by means of spacing standoffs 33 and provided with a bearing 34 or 35, by means of which swing-slide frame 30 is slidably guided on shaft 36.

A lever 39 is mounted between front panel 31 and rear panel 32 of swing-slide frame 30, said shaft being mounted rotatably in machine housing 10 by means of two bearings 37 and 38 (FIG. 1), but axially nondisplaceably, to which lever, by means of its piston rod, a pneumatic swing-pressure cylinder Z4 is articulated for steering the swing-slide frame 30 into the mutually opposite end swing positions of stripping arrangement 50 and crimping arrangement 100 at cable lead inlet 20, said lever, according to FIGS. 1 and 2, engaging swing-slide frame 30 at a drive rod 40 parallel to its swing axis, said rod connecting front panel 31 and rear panel 32 of swing-slide frame 30 with one another in the same way as standoffs 33, and passing slidably through it.

Lever 39 simultaneously forms the counterbearing for a pneumatic slide-pressure cylinder Z3, engaging front panel 31 of swing-slide frame 30 with its piston rod, for steering swing-slide frame 30 into two mutually opposite end slide positions.

To delimit swing-slide frame 30 in the first and second end swing positions with stripping arrangement 50 or crimping arrangement 100 at cable lead inlet 20, according to FIG. 2 two adjustable stops 41 and 42 are provided for lever 39.

Drive rod 40 of swing-slide frame 30 is formed on the end projecting toward front wall 11 of housing 10 from front panel 31 of frame 30, according to FIG. 1, as a locking pin 45 to lock swing-slide frame 30 in the end swing positions following its brief sliding travel from the second end slide position to the first end slide position. Locking pin 45 cooperates with two locking bores 46, which, according to FIGS. 1 and 2, are provided on bearing block 47, integral with the housing, of front wall bearing 37 for shaft 36, on which swing-slide frame 30 is mounted axially displaceably.

Stripping arrangement 50:

According to FIGS. 5–8 in particular, it comprises a stripper gripper 51, which is mounted with one-armed legs 53 each having an interchangeable cutting plate 52 and cooperating with one another, within a rotatably mounted tubular sleeve 54 on its cross pin 55 rotatably mounted about an axis which, in its first end swing position, is flush with the axis of cable lead inlet 20, and extending, with its gripper opening projecting out of tubular sleeve 54, beyond front panel 31 of swing-slide frame 30 as far as front wall 11 of the housing. A bell-cylindrical tubular slide 56 is slidably guided in tubular sleeve 54, said slide having in its wall two diametrally opposite elongated holes 57 traversed by cross pin 55 of tubular sleeve 54, and serving with inner cone 58 provided at its open end as an actuating element for stripper gripper 51, whose legs 53 are spread against inner cone 58 by a compression coil spring 59. Opening and closing acutation of stripper gripper 51 are provided by a pneumatic stripping pressure cylinder Z2 (see also FIG. 1) with whose piston tubular slide 56 is rotatably coupled by its bottom 60.

At the end which points toward rear panel 32 of swing-slide frame 30, tubular sleeve 54 has a crown gear 61, which meshes with a pinion 63 on the shaft of an electric motor 62, said motor being electrically powered by slip rings 71 and current-collecting brushes, not shown.

On front panel 31 of swing-slide frame 30, according to FIGS. 1, 5, in addition to the opening for the stripper gripper, a guide funnel 64 is mounted, which guides the cable lead end KE, to be stripped, of cable lead K, inserted into cable lead inlet 20, into the stripper gripper opening so that it is exactly coaxial with tubular sleeve 54.

For exact adjustment of stripper gripper 51 to the thickness of the core and of the insulating jacket of cable lead K (see FIG. 1*a*), according to FIG. 5 the stripper pressure cylinder Z2 which actuates the closing of stripper gripper 51 is mounted on a support 65, which is displaceably mounted on two standoffs 33 connecting front panel 31 and rear panel 32 of swing-slide frame 30 in the axial direction of stripper pressure cylinder Z2, and is adjustable by means of an adjusting spindle 66 mounted in front panel 31 of swing-slide frame 30. Adjusting spindle 66 has a threaded end 67 engaged in a threaded bore 68 in support 65 and has a rotating handle 69 and a locking handle 70 on the end that projects out of front panel 31 toward front wall 11 of housing 10.

Crimping arrangement 100:

According to FIGS. 9–11 in particular, it is provided with a lead end tip gripper 101, which simultaneously, on the one hand with crimping jaws 102 and 103, forms a crimping gripper and on the other hand with (one each) spring-loaded gripping jaws provided slidably guided on crimping jaws 102 and 103, counteracting a compression coil spring 104, forms a gripper, so that it receives lead end tip A supplied to the crimping arrangement 100 for mounting on and crimping on stripped cable lead end KE and is tensioned on plastic collar b, but lead tip A with its metal tubular part a is crimpable by crimping jaws 102 and 103 onto cable lead end KE (FIGS. 9 and 10).

Two armed gripper levers 106 and 107 are spaced axially between a pair of bearing plates 108 on front panel 31 of swing-slide frame 30 and pivotably coupled with one another in opposite pivoting directions by one toothed segment 109 each. Gripper levers 106 and 107 are so disposed on swing-slide frame 30 that they project with their short arms 110 which support crimping jaws 102 and 103 toward front wall 11 of housing 10, beyond front panel 31 of swing slide frame 30.

On their long arms 111, gripper levers 106 and 107 are each applicable, by means of a roller 112, to a trapezoidal spreading element 113 on the piston rod of a pneumatic crimping pressure cylinder Z6 to operate gripper 101 as a crimping gripper.

In order to allow crimping jaws 102 and 103 and also gripping jaws 105 to operate flush with one another during mutual guidance, gripping jaws 102 and 103 on short arm 110 of gripper levers 106 and 107 are articulated by a pin 114 or 115. On short arm 110 of gripper lever 106, a coupling element 116 is articulated with articulating pin 114 for crimping jaw 102 as an articulation axis, in the recess 117 of said element 116 a pneumatic lead end tip gripping/return pressure cylinder Z5 is mounted for actuating gripper 101 as a holding gripper and for return actuation of gripper 101 in the open position with a bead provided on the end of the piston rod with axial play provided such that it can act on the lead tip gripper 101, in the opposite direction each time, only after an empty stroke.

In this way, independent actuation of gripper 101 by pneumatic pressure cyinders Z5 and Z6 is assured.

According to FIGS. 11 and 13, crimping jaw 102 is provided with two guide pins 119 for mutual guidance of crimping jaws 102, 103, said pins 119 engaging corresponding guide bores 120 of crimping jaw 103. The spring-tensioned gripping jaws 105, according to FIGS. 11 and 12, are slidably guided on two guide rods 121, which are secured permanently on the one hand in a projection 122 of crimping jaw 102 and on the other hand are slidably guide in a projection 123 of crimping jaw 103.

Crimping jaw projections 122 and 123 simultaneously serve as counterbearings for compression coil springs 104, against which clamping jaws 105 are flexibly tensioned by springs.

In crimping jaws 102 and 103, according to FIGS. 9–11, a lengthwise groove 125 is provided in their direction of motion, into which groove the gripping jaw 105 which is actuated by a compression spring at a given moment engages with a stop pin 125.

Crimping jaws 102 and 103 and gripping jaws 105 are dimensioned with respect to one another according to FIGS. 11–13 in such fashion that when gripper 101 is open as shown in FIGS. 11 and 12, they form a receiving opening 126, flanked laterally by guide pins 119 and guide rods 121, for lead tip A fed to gripper 101 with metal tubular part a forward, said tip entering gripping jaws 105.

According to FIGS. 11 and 12, gripping jaws 105 are each provided with semicircular grooves 127 in the end faces opposite one another, by means of which grooves they can positively grip plastic collar b of lead tip A during the clamping process.

According to FIGS. 12, 14, and 16–18 a trapezoidal groove 129 is provided in the end face 128 of crimping jaw 103 which is opposite crimping jaw 102, with the base surface of which it cooperates during the crimping process on the metal tubular part a of lead tip A and with whose flanks it flanks receiving opening 126 for lead tip A. The other crimping jaw 102 on the other hand acts on the metal tubular part a of lead tip A with a trapezoidal strip-shaped nose 130 which matches the groove 129 in crimping jaw 103.

In order for gripper 101 to receive the lead tip A supplied to it for crimping onto stripped cable lead end KE in the vertical axial position, and then mounting and crimping it on the stripped cable lead end in the horizontal axial position, the assembly formed by crimping jaws 102 and 103 and gripping jaws 105 is tiltable about a tilting axis 131 parallel to its direction of motion, said axis intersecting the articulation axes of crimping jaws 102 and 103 and the axis of receiving opening 121 at right angles, cf. FIGS. 9, 11–14, 19, 20.

For this purpose, according to FIGS. 9–11, 14, crimping jaws 102 and 103 are mounted tiltably on an articulation fork 132 which provides articulation on short arms 110 for gripper levers 106 and 107 respectively, rib 133 of said fork, provided with a bearing bore, being traversed by headed bolts 134 or 135, to which crimping jaws 102 and 103 are mounted and fastened with a cotter pin by means of bore 135 pointing in its [own] direction of motion.

Headed bolt 134 of one crimping jaw 102 has a length such that, by projecting into through-bore 136 of the other crimping jaw 103, forms a stop delimiting the depth of receiving opening 126 for metal tubular part a of lead tip A (FIG. 14).

Crimping jaw 103, according to FIG. 2, 19, (15), 20, in the final phase of steering pivot-slide frame 30 into the first end swing position with a pin 137 eccentric with respect to swing axis 131 is located between guide strips 138 of a fork 139 integral with the housing as a deflecting element (cf. in particular FIG. 2, right, center), whereby, during the steering of swing-slide frame 30 into one end slide position (arrow in FIG. 19) the assembly formed by crimping jaws 102 and 103 and gripping jaws 105 moves from the vertical tilted position (Figure 19) to receive a new lead tip A into a horizontal tilted position (Figure 20) for mounting and crimping. During steering of swing-slide frame 30 into the other end slide position, this change of swing positions by jaws 102, 103, and 105 is repeated (from FIG. 20 back to FIG. 19).

Lead tip feed arrangement 200:

It feeds crimping arrangement 100 and according to FIGS. 2 and 21 is provided with a lead tip supply container 201 mounted outside housing 10 in the form of a vibrating conveyor (not shown in greater detail), a vertical lead tip feed shaft tool 2 which receives lead tips a from said conveyor in the vertical axial direction and with the metal tubular part a forward, said shaft being inserted from above into housing 10 between its front wall 11 and front panel 31 of swing-slide frame 30, and a lead tip sorting arrangement 203, controlling lead tip feed shaft 202, said arrangement 203, each time it is actuated, feeding a single lead tip A to crimping arrangement 100.

Lead tip sorting arrangement 203:

According to FIGS. 21–29, it is provided with a U slide 204, which, according to FIG. 29 in particular, comprises two fingers 205 and 206 disposed one above the other and with a distance between them in lead tip feed shaft 202, and guided in a slide guide in the form of a slide housing 207, which has a guide recess 208 corresponding to its cross section. In a housing rib 209, extending over the length of guide recess 208, said rib fitting over slide 24 with its fingers 205 and 206, a bore 210, delimited by slide fingers 205 and 206, with a length (slightly) greater than the length of the lead tips is provided; said bore, together with two tubes 211 and 212, one of which is inserted from above up to upper finger 205 and the other from below up to lower finger 206 into slide housing 207, forms the lead tip feed shaft 202.

For additional guidance of slide 204 in slide housing 207, two standoffs 213 are provided, mounted in slide housing 207, said standoffs containing guide bores 215 provided in the direction of motion of slide 204 in main body 214 of slide 204. Slide 204 is held in one end position by two pre-tensioned compression coil springs 216 abutting it and [abutting] slide housing 207, said springs being traversed by standoffs 213, said end position being delimited by a stop plate 217 screwed to slide housing 207.

Upper side finger 205, especially according to FIGS. 28 and 29, comprises a bore 218 matching the diameter of lead tip feed shaft 202 and a slot 219 extending from said bore toward stop plate 217, said slot being of a slightly greater width than the diameter of metal tubular part a of lead tip A, the two of them (218 and 219) expanding toward the upper section of lead tip feed shaft 202 formed by tube 211 and combining to form a keyhole shape.

Lower slide finger 206, according to FIGS. 28 and 29 in particular, on the other hand, has only one bore 220 corresponding to the diameter of lead tip feed shaft 202. Bore 218 in upper finger 205 and bore 220 in lower finger 206 are staggered with respect to one another in such fashion that in the end position of slide 204 delimited by stop plate 217, bore 217 [sic] in upper finger 205 is flush with feed shaft 202 and bore 220 in lower finger 206 is displaced out of the vicinity of lead tip feed shaft 202.

In this way, a lead tip A can be fed from tube 211, inserted from above as far as upper slide finger 205 into slide housing 207, said tube forming a lead tip magazine as the upper section of lead tip feed shaft 202, into the segment of lead tip feed shaft 202 which is formed by slide housing bore 210. The lead tip which follows the fed tip out of the lead tip magazine, held with a partial length of metal tubular part a against plastic collar b of fed lead tip A, projects with metal tubular part a into slide housing bore 210 (FIGS. 25, 26).

If slide 204 is then slid against the force of compression coil springs 216 out of the end position delimited by stop plate 217 into the other end position, bore 220 in lower slide finger 206 is aligned with lead tip feed shaft 202 and bore 218 in upper slide finger 205 is moved out of alignment with lead tip feed shaft 202, whereby slot 219 which originates in bore 218 in upper slide finger 205 crosses lead tip feed shaft 202. In this way, the lead tip stored in slide housing bore 210 is released into the tube 212 which forms the section of lead tip feed shaft 202 for feeding crimping arrangement 100, and is blocked with the next lead tip projecting with metal tubular part a in slide housing bore 210 by upper slide finger 205 from gaining access to slide housing bore 210.

According to FIG. 2, lead tip feed shaft 202 is so arranged that when swing-slide frame 30 is swung into the first end swing position and slid into the first end slide position, [202] is positioned with its opening near the lead tip receiving opening 126 of crimping arrangement 100 (FIG. 11).

Lead tip sorting arrangement 203 is actuated to feed crimping arrangement 100 with one lead tip A at a time by a pin 227 mounted on front panel 31 of swing slide frame 30 (FIG. 2), said pin, when steering swing-slide frame 30 in the first end swing position, pressing slide 204 from the second end slide position to the first end slide position of lead tip sorting arrangement 203 through a bore 221 in stop plate 217 of lead tip sorting arrangement 203 (FIGS. 21, 22, 27).

Tube 211, which is designed as the upper segment of lead tip feed shaft 202, comprises two receptacles 222 and 223 each holding a photocell, which monitor the minimum and maximum filling levels of the lead tip magazine and turn the tip supply container 201 on and off as a vibrating conveyor depending on the fullness of the magazine.

Operation of the first embodiment of the machine:

This is described with reference in particular to FIGS. 1 and 2 as well as the operational flowchart shown in FIG. 30, which shows in sequence the automatic operating cycle of pneumatic pressure cylinders Z1 to Z6 operated by switches S1 to S10 and electric motor 62 from the start of the machine until it is again ready to start again, on the basis of the successive operating segments T1 to T9 from the start of the machine until it is ready to start again. In view of the details of operating segments T1 to T9, mention is made expressly of FIG. 30, in order to avoid as many repetitions as possible in the text which follows.

When the machine is ready to start again after the last operating step T9, swing-slide frame 30 is in the first end swing position and in the first end slide position, whereby stripper arrangement 50 pivots against cable lead inlet 20 and is slid together with cable lead guide funnel 64 close to the steered cable lead gripping arrangement 22. At this time (FIG. 11), crimping arrangement 100, with lead tip gripper opening 126 open, is positioned at the opening of lead tip feed shaft 202 of lead tip feed arrangement 200, from which it has received a lead tip A in the final phase of the last operating step T9.

When a cable lead end KE, provided with a lead tip A to be crimped, is inserted through feed funnel 21 and the controlled cable lead gripping arrangement 22 of cable lead insert 20, as well as through guide funnel 64 of stripper arrangement 50, into the machine for a distance such that, by projecting into the opening of the controlled stripper gripper 51, actuates a limit switch S1 therein; the latter in turn, in order to initiate the operating step T1, triggers the closing operation of cable lead gripping arrangement 22 by cable lead gripping pressure cylinder Z1 and closing operation of stripper gripper 51 by stripper pressure cylinder Z2 as well as the gripping of lead tip A in crimping arrangement 100 by lead tip gripping return pressure cylinder Z5.

After operating step T1 is complete, to initiate operating step T2 by means of a limit switch S2 which detects the piston position of pressure cylinder Z5, swing slide frame 30 is steered into the second slide frame position by means of slide pressure cyinder Z3, and electric motor 62 is turned on with a slight delay, said motor, by means of pinion 63 and crown gear 61, driving tube slide 56 and consequently stripper gripper 51, which in its closed position nicks the insulating jacket of the cable leads K down to its metal wire core using cutting plates 52, for several revolutions, said gripper simultaneously being slid into the second end slide position by the action of swing-slide frame 30, so that a portion of the insulating jacket of cable lead end KE is cut off and then stripped away, whereby cutting plates 52 execute a helical motion along the metal wire core, and additionally twist the latter, so that spreading of the latter is prevented, which could interfere with or even prevent the mounting of a lead tip.

After operating step T2 is completed, swing-slide frame 30 is slid into the second end slide position and the stripped cable lead end KE is released through the guide funnel 64 of stripper arrangement 50 and running-time-controlled electric motor 62 is shut off, in order to initiate operation step T3, by means of a limit switch S3 which detects the second end slide position of swing-slide frame 30 against its rear plate 32, swing-slide frame 30 is steered into the second end swing position by swing pressure cylinder Z4 and stripper gripper 51 is controlled by stripper pressure cylinder Z2. After operation step T3 is complete, and swing-slide frame 30 is steered into the second end swing position so that crimping arrangement 100 is swung against cable lead inlet 20, to initiate operating step T4 by means of limit switch S4 (FIG. 2) which determines the second end swing position of swing-slide frame 30 against its lever 39, displacement of swing-slide frame 30 into the first end slide position by slide pressure cylinder Z3 is triggered, whereby lead tip A, gripped in crimping arrangement 100, is positioned on stripped cable lead end KE.

After operating step T4 is completed, and lead tip A is mounted on stripped cable lead end KE, to initiate operating step T5 by means of limit switch S5 which determines the first end slide position of swing-slide frame 30 against its rear plate 32, crimping of lead tip A on stripped cable lead end KE by crimping pressure cylinder Z6 is triggered.

As soon as the pressure in crimping pressure cylinder Z6 has reached the value required for crimping metal tubular section a of lead tip A by crimping jaws 102 and 103, to initiate operating step T6, the reverse control of pressure cylinder Z5 and Z6 is triggered by a pressure-controlled switch S6 which detects it so that the crimped lead tip is released from lead tip gripper 101 in crimping arrangement 100.

After operating step T6 is completed, in order to initiate operating step T7 by means of a limit switch S7 which detects the release of the crimped lead tip from the grip of crimping arrangement 100 at lead tip gripping/return pressure cylinder Z5, swing-slide frame 30 is steered into the second end slide position by slide compression cylinder Z3 and actuation of limit switches S3 to S8 triggers the steering of cable lead gripper 22 for the complete extraction of the finished cable lead end KE, as determined by a switch S8 (e.g. a photocell) (FIG. 1) by cable lead gripping pressure cylinder Z1, which actuates a limit switch S10 (FIG. 1).

By means of limit switch S3, which determines the second end slide position of swing-slide frame 30, the inward travel of the piston of swing pressure cylinder Z4 is triggered, so that swing slide frame 30 swings back into the first end swing position.

Finally, after operating step T8 is completed, in order to initiate operating step T9 by means of limit switch S9 which detects the fist end swing position of swing-slide frame 30, the extension of the piston of slide pressure cylinder Z3 is triggered, which pushes swing-slide frame 30 back into the first end slide position, so that the machine is ready for another start.

A second embodiment of the machine according to the invention will now be described with reference to FIGS. 31–44, said machine differing from the first embodiment described above essentially by the following:

- simpler, more compact overall design with smaller moving masses;
- (especially) extensive mechanical linkage of the lead tip crimping arrangement with the stripping arrangement by means of a common driving pressure cylinder;
- stripping arrangement without rotary drive; and
- increasingly separated drive of lead tip fitting arrangement and lead tip crimping arrangement.

To the extent that switch S and pressure cylinder Z of the second embodiment correspond to those of the first embodiment, this is indicated by corresponding reference marks, wherein a "'" is added for the second embodiment after "Z" (for pressure cylinder) and "S" (for switch), so that for example "Z'1", "S'1" of the second embodiment correspond to "Z1" and "S1" of the first embodiment. In the second embodiment, therefore, a single stripping/crimping pressure cylinder Z'2/6 corresponds to pressure cylinders Z2 and Z6 in the first embodiment for driving the stripping arrangement or the crimping tool, said cylinder representing the common driving pressure cylinder for the stripping arrangement and the crimping arrangement; similarly, switch S'2/6 in the second embodiment corresponds to switches S2 and S6 of the first embodiment.

This machine comprises the following assemblies:

- a machine housing 500,
- a cable lead inlet 520 on a front wall 506 of housing 500,
- a slide frame 550, displaceable in housing 500 (cf. especially FIGS. 31–33);
- a swing frame 570, swingably mounted by slide frame 550;
- a stripping arrangement 600 to strip the cable lead ends, whose stripping tool 601, etc. is supported by swing frame 570 and therefore also by slide frame 550 and consequently is swingable and slidable toward cable lead inlet 520,
- a lead tip mounting arrangement 650 for mounting a lead tip A on the stripped cable lead end KE of a cable lead K, said device also being supported by swing frame 570 and hence also by slide frame 550, and thereby being swingable and slidable alternately with stripping tool 601 of stripping arrangement 600 toward cable lead inlet 520,
- a lead tip crimping arrangement 700, disposed in swing frame 570 behind mounting arrangement 650, for crimping lead tips on the stripped cable lead ends, which were previously fitted with the corresponding lead tips by mounting arrangement 650;
- a lead tip feed arrangement 750 (cf. especially FIGS. 31–34) with a lead tip supply container 752, a lead tip feed shaft 754 and a lead tip sorting arrangement 756 supplying the latter, which differs from that in the first embodiment (cf. especially FIGS. 23–29) only in that sorting arrangement 756 is actuated by a hydraulic sorting pressure cylinder Z'7; in addition, a sight glass 758 is shown.

In detail:

Machine housing 500:

According to FIGS. 31, 32, 34, 37 in particular, it comprises a bottom panel 502 provided with feet 501 and a slide tray 504 guided along its underside in lateral guide tracks 503, said tray being slid inward to receive the stripping scrap beneath a recess 505 in bottom panel 502. In addition, it possesses the integrally rigid front wall 506 which supports cable lead inlet 520, said wall being articulated at the bottom by means of hinges 507 as a folding wall against floor panel 502 of housing 500, and having at the top a key-actuated rotary latch 508 to lock it to housing 500.

To prevent the machine from starting accidentally with front wall 506 folded down to change tools, a safety switch (not shown) is associated with rotary latch 508.

Cable lead inlet 520:

According to FIGS. 37, 38, 40, 41, 42*a*, and *b* in particular, it comprises a cable lead inlet funnel 521 running along the horizontal axis and passing through front wall 506 from the outside, and a cable lead gripping arrangement 522 located behind, mounted on the inside of front wall 506 with a bottom panel 523, with a cable lead gripping pressure cylinder Z'1 provided for actuation of the gripper.

Cable lead gripping arrangement 522 in turn consists of a gripper 525 with two two-armed gripper levers 526, mounted opposite one another on base plate 523, said levers gripping a spreading spring 529 made in the form of a coil compression spring by means of one arm 528 comprising a gripping jaw insert 527 and, with the other arm 530, abutting by means of a roller 531 a conical spreading element 532 on the piston rod 535 of the cable lead gripping pressure cylinder Z'1, mounted with cylindrical part 536 on bottom panel 502 of housing 500.

To align the cable leads gripped by cable lead gripping arrangement 522 in the axis of cable lead inlet 520, two centering plates 538, mounted behind the opening of the grippers, one each on gripping jaw arms 528 of gripper lever 526 (see especially FIGS. 37, 38, and 43), which overlap one another and, each with a triangular recess 541 originating at overlapping corner 539, delimiting a quadrilateral passageway 543 which lies on the axis of cable lead inlet 520, the lateral length, with cable lead gripping arrangement 522 open, being a multiple of the cable lead diameter and being reduced to the diameter of the cable leads until the cable lead, during the closing action of cable lead gripping arrangement 522, is gripped by gripping jaw inserts 527 of gripper levers 526.

According to FIGS. 37 and 38 in particular, cable lead inlet funnel 521 runs through a recess 545 in base plate 523 of cable lead gripping arrangement 522 with its end located on the inside of the housing being reduced to a small diameter coming close to centering plates 538 between gripper levers 526 and having at its end a transverse groove 548 whose width corresponds to the diameter of the hole in the neck of the funnel 546, into which groove gripping jaw projections 527 of gripper levers 526 project.

To increase their gripping ability, the gripping surfaces, which face one another, of gripper jaw inserts 527 have sawtooth surfaces.

Slide frame 550:

According to FIGS. 31, 32, 33*a*, and 33*b* in particular, it is slidably guided in housing 500 and comprises a base plate 551 and on its underside two bearing eye pairs 553, by means of which it is displaceable on a pair of guide rods 555 fixed to bottom panel 502 of housing 500 in the direction of the axis of cable lead inlet 520.

Between guide rod pair 555 is a sliding pressure cylinder Z'3 whose axis is parallel to said pair, said cylinder serving to steer slide frame 550 into two opposite end slide positions P1 and P2 as shown in FIGS. 33*a* and *b* and for this purpose is mounted with its cylinder part 557 on bottom panel 502 of housing 500 and with its piston rod 558 in a lower projection 560 of bottom panel 551.

Swing frame 570:

According to FIGS. 31 and 32 in particular, it is swingably mounted about an axis which intersects the axis of cable lead inlet 520 at right angles, in side cheeks 562 of bottom panel 551 of slide frame 550. On bottom panel 551 of slide frame 550 is a swing pressure cylinder Z'4 for steering swing frame 570 into two end swing positions P3, P4, 90° apart, according to FIGS. 31, 33*a* and 33*c* in particular, said cylinder being articulated by its cylinder part 573 on bottom panel 551 of slide frame 550 and, according to FIGS. 31 and 35 in particular, engaging its piston rod 577 provided with a bearing eye 575 on swing frame 570, eccentrically to its swing axis.

Two stops (not shown) are provided for the end slide position delimitation of slide frame 550 and the end swing position limitation of swing frame 570.

Stripper arrangement 600:

According to FIGS. 31–37 in particular, it comprises a stripper gripper 601 with two two-armed gripper levers 603 extending on both sides of the extended axis of cable lead inlet 520, each of said levers being swingably mounted about a vertical bearing axis on base plate 551 of slide frame 550 and articulated by means of long lever arm 604 facing away from front wall 506 of housing 500 by means of a connecting link pair 605 to a piston rod yoke 606 of a stripping/crimping pressure cylinder Z'2/6 for opening and closing actuation of stripper gripper 601, which is fastened to base plate 551 of slide frame 550 by its cylinder part 607.

According to FIGS. 35, 36, and 39 in particular, gripper levers 603 engage positively with short lever arm 608 a gripper jaw pair 610 separate from stripper gripper 601, said pair 610 being slidably guided on swing frame 570 on a guide rod pair 611 parallel to its swing axis, and, in the first end swing position P3 of swing frame 570 as shown in FIGS. 31 and 33, jointly with guide rod pair 611, flanking the axis of cable lead inlet 520 according to FIGS. 35–37 in particular. The jaws of gripper jaw pair 610 are each provided with a cutting plate 614 provided with alternate cutters 613, with which plate they flank a stripper jaw opening 631.

Cutting plates 614 are mounted on the jaws of gripper jaw pair 610, according to FIGS. 35 and 39 in particular by a screw 616, which is screwed into a internally threaded bushing 619 fitted into a gripper jaw bore 617 and anchored in the latter as shown in FIG. 35 by a pin 618, and thereby traverses a cylinder body 622 provided with a toggle 621, said body being mounted on the end of internally threaded bushing 619 which projects out of gripper jaw bore 617 and, projecting with an eccentric projection 624 into a bore of cutting plate 614, forms an adjusting eccentric for cutting plate 614.

The positive connection between stripper gripper 601 and separate gripper jaw pair 610 is produced by virtue of the fact that short lever arm 608 of gripper lever 603, by means of a forked opening 626 fits over a dog projection 627 provided on the jaw of gripper jaw pair 610.

According to FIG. 37 in particular, a guide funnel 629 mounted close to a stripper jaw opening 631 is fastened to a front panel 578 of swing frame 570. Said funnel, when according to FIGS. 31 and 33*a* the swing frame 570 is swung into the first end swing position P3 and slide frame 550 is slid into the first end slide position P1, guides cable lead K, inserted into cable lead inlet 520 with the end KE to be stripped exactly aligned with the axis of cable lead inlet 520 into stripper gripper opening 631.

Stripper arrangement 600 has associated with it a stripper 633 mounted on slide frame 550, said stripper, when swing frame 570 is being steered into the second end swing position P4, entering behind cutting plates 614 of stripper arrangement 600, and thus, after stripping, removes any remaining insulating jacket residue from the cable, from cutting plates 614, or from between cutting plates 614 and switch S'1. Switch S'1 in this case is designed as an inductive proximity switch known of itself, as is evident from FIG. 37, center, and has a fixed tubular part 637 and a part 639 on a leaf spring 641 movable against said part 637.

Lead tip mounting arrangement 650:

According to FIG. 37 in particular, it consists of two slides slidably guided on swing frame 570 on a common pair of guide rods 652 parallel to the swing frame swing axis, said slides, each controlled by a lead tip gripping pressure cylinder Z'5 mounted on swing frame 570, each having a mounted gripping jaw 656 to form a gripper which in the open position receives a lead tip A fed to it with the metal tubular part a forward with plastic collar b and holds it in the closed position.

According to FIGS. 32, 37, and 38 in particular, gripping jaws 656 are provided in the end faces opposite one another each with a semicircular groove 660, with which they grip plastic collar b of lead tip A positively during the gripping process.

According to FIG. 37 in particular, gripping jaws 656 comprise bores in the end faces opposite one another to receive two guide rod pairs 662 and 663, which are slidably guided in one gripping jaw 656 and in the other gripping jaw 656, permanently seated, and which flank the receiving opening 665 for lead tip A formed by open gripping jaws 656.

Mounting arrangement 650 is so disposed on swing frame 570 that when swing frame 570 is in the first end swing position P3 according to FIGS. 31 and 33*a* in particular, when lead tip receiving and gripping opening 665 according to FIG. 37 in particular is positioned at the opening of the vertical lead tip feed shaft 754 of lead tip feed arrangement 750 and when swing frame 570 is in the second end swing position P4 according to FIG. 33 in particular, is flush with the axis of cable lead inlet 520, so that it can push the gripped lead tip A with plastic collar b forward onto the stripped cable lead end KE.

Lead tip crimping arrangement 700:

According to FIG. 37 in particular, it comprises two crimping jaws 702, 703 disposed opposited one another behind lead tip receiving and gripping opening 665 of mounting arrangement 650, said jaws flanking metal tubular part a of lead tip A received and gripped together with plastic collar b by mounting arrangement 650, said tip A projecting out of mounting arrangement 650.

Crimping jaws 702, 703, according to FIGS. 36, 37, 39 in particular, are guided with their crimping ends in a crimping chuck 707 possessing a guide groove 705, said chuck being mounted close to mounting arrangement 650 with guide groove 705 centrally on lead tip receiving and gripping opening 665, thus forming with the bottom of guide groove 705 a positioning stop for lead tip A received and gripped by mounting arrangement 650 with plastic collar b.

According to FIG. 39, a trapezoidal groove 709 is provided in the end face of crimping jaw 703 opposite crimping jaw 702, with the aid of which groove it acts upon metal tubular part a during crimping of a lead tip A mounted with plastic collar b forward on the stripped cable lead end. The other crimping jaw 702, on the other hand, acts on metal tubular part a of lead tip A with a strip-shaped nose 711 provided on its end face with a trapezoidal cross section matching groove 709 of crimping jaw 703.

According to FIGS. 36–39, crimping jaws 702, 703 are each mounted on one jaw of a gripping jaw pair 713, which is slidably guided on swing frame 570 on a guide rod pair 715 parallel to its swing axis, and flanks lead tip receiving and gripping opening 665 of lead tip mounting arrangement 650.

To actuate lead tip crimping arrangement 700, by means of the stripping/crimping pressure cylinder Z'2/6, in the second end swing position P4 of swing frame 570, instead of gripper jaw pair 610 of stripper arrangement 600 (in the first end swing position of swing frame 570), gripper jaw pair 713 of crimping arrangement 700, with one projection 17 on each gripping jaw, engages gripper lever 603 of stripper arrangement 600.

According to FIGS. 37, 39, crimping chuck 707 is disposed between gripping jaw pair 713 on guide rod pair 715 and positioned by a locking screw 720.

Operation of the second embodiment of the machine:

It is described with special reference to FIGS. 31, 33*a*–33*c* and the operating flowchart as shown in FIG. 44, which indicates in sequence the automatic operating cycle, effected by switches S'1 to S'8 of pneumatic pressure cylinders Z'1 to Z'7 from the moment the machine starts until it is again ready to start, with reference to the successive operating segments T'1 to T'11 from the moment the machine starts until it is again ready to start. For details of the operating segments T'1 to T'11, express reference is made to FIG. 44.

When the machine is ready to start again after the last operating step T'11, according to FIGS. 31 and 33*a* slide frame 550 is in the fist end slide position T1 and the swing frame 570 carried thereby is in the first end swing position P3, in which the stripper tool 614 of stripper arrangement 600, supported by swing frame 570, swings with the cable lead guide funnel 629 ahead of it against cable lead gripping arrangement 522 and is slid close to the latter. Mounting arrangement 650 and crimping arrangement 700, located behind it, are then postioned with the lead tip receiving and gripping opening 665 and open crimping opening at the opening of lead tip feed shaft 754 of lead tip feed arrangement 750, from which mounting arrangement 650 has received a lead tip in the final phase of the penultimate operating step T'10.

If now a cable tip end provided with a lead tip for mounting by crimping is introduced into the machine through feed funnel 521 and controlled cable tip gripping arrangement 522 of cable lead inlet 520 as well as through guide funnel 629 of stripper arrangement 600 to the point where it actuates a limit switch S'1 according to FIG. 37 in particular in the mouth of controller stripper gripper 601, said switch in turn, in order to initiate operating step T'1, initiates the closing action of cable lead gripping arrangement 522 by cable lead pressure cylinder Z'1 and the closing action of stripper gripper 601 by stripper/crimper pressure cylinder Z'2/6 as well as the gripping of lead tip A in mounting arrangement 650 by lead tip gripping pressure cylinder Z'5.

After operating step T'1 is complete, to initiate operating step T'2 by means of a limit switch S'2/6 which determines the piston position of stripper/crimper pressure cylinder Z'2/6 slide frame 570 is steered into the second end slide position P2 as shown in FIG. 33 by slide pressure cylinder Z'3, whereby stripper/gripper 601, in its end closed position, notches the insulating jacket of cable lead end KE or cuts down to its metal wire core with cutting plates 614, when slide frame 550 is steered into the second end slide position P2 as shown in FIG. 33*b*, pulls the end segment, partially cut off by the notches, of the cable lead insulating jacket off the metal wire core.

After operating step T'2 has been completed and slide frame 550 has been slid into the second end slide position P2, so that stripped cable lead end KE is exposed by guide funnel 629 of the stripper arrangement, in order to initiate operating step T'3 by means of a limit switch S'3 which determines the second end slide position P2 of slide frame 550, the steering of swing frame 570 into the second end swing position P4 as shown in FIG. 33*b* by swing compression cylinder Z'4 and the steering of stripper/gripper 601 by stripper/crimper pressure cylinder Z'2/6 is triggered.

After the completion of operation step T'3, as soon as swing frame 570 has been steered into the second end swing position P4 so that mounting arrangement 650 as well as crimping arrangement 700, located behind it, have swung into the axis of cable lead inlet 620, to initiate operating step T'4 by means of a limit switch S'4 which detects the second end swing position P4 of swing frame 570, displacement of slide frame 550 into the first end slide position P1 is triggered by slide pressure cylinder Z'3, whereby the lead tip gripped in mounting arrangement 650 is pushed onto stripped cable lead end KE and positioned.

As soon as operating step T'4 is complete, as soon as the lead tip is mounted on the stripped cable lead end, to initiate operating step T'5 by a limit switch S'5 which determines the first end slide position P1 of slide frame 550, crimping of lead tip A on stripped cable lead end KE by stripper/crimper pressure cylinder Z'2/6 is triggered.

As soon as lead tip A has been crimped, to initiate operating step T'6 by switch S'2/6 which determines the piston position of stripping/crimping pressure cylinder Z'2/6 (preferably a simple magnetic switch), the reverse control of stripping/crimping pressure cylinder Z'2/6 and that of lead tip gripping pressure cylinder Z'5 are triggered so that the crimped lead tip is released from its grip in mounting arrangement 650 and released by crimping jaws 702, 703 of crimping arrangement 700.

After operating step T'6 is complete, to initiate operating step T'7 by a limit switch S'7 which detects the release of the crimped lead tip by crimping jaws 702, 703 of crimping arrangement 700, said switch being mounted on the piston of stripping/crimping pressure cylinder Z'2/6, the steering of slide frame 570 to the second end slide position P2 by slide pressure cylinder Z'3 is triggered.

After completion of operating step T'7, as soon as slide frame 550 has been slid into second end slide position P2, to initiate operating step T'8 by switch S'3 which determines the second end slide position of slide frame 550, without said switch acting on stripping/-crimping pressure cylinder Z'2/6, steering of swing frame 570 into the first end swing position P3 by swing pressure cylinder Z'4 and steering of cable lead gripping arrangement 522 by cable lead gripping pressure cylinder Z'1 is triggered.

After operating step T'8 is complete, to initiate operating step T'9 by a switch S'8 which determines the first end swing position P3 of swing frame 570, steering of slide frame 550 into the first end slide position P1 by slide pressure cylinder Z'3 is triggered.

After completion of operating step T'9, as soon as slide frame 550 has been slid into the first end slide position P1, to initiate operating step T'10 by switch S'5 which detects the first end slide position P1 of slide frame 550, without the latter however acting on stripping/crimping pressure cylinder Z'2/6, release of one lead tip from lead tip sorting arrangement 756 via sorting pressure cylinder Z'7 according to FIG. 31, 34 is triggered, whereby mounting arrangement 650, which is ready to receive at the opening of lead tip feed shaft 754 of lead tip feed arrangement 750, is fed one lead tip A. The final operating step T'11 is initiated by the pressure relief of sorting pressure cylinder Z'7 which takes place after operating step T'10 is completed, said step T'11 being terminated when the piston of sorting pressure cylinder Z'7 has returned to its starting position before operating step T'10.

After the last operating step T'11 is completed, the machine is ready to start again.

I claim:

1. A machine for fastening a connector to a cable end, the connector comprising a crimpable sleeve and a portion not to be crimped, the machine comprising:

(a) a stationary inlet to receive the cable end;

(b) means to feed separate individual connectors to the cable end; and (c) means for crimping said connector sleeve around said cable end, said crimping means comprising a crimping/mounting element having, (1) crimping jaws for crimping said crimpable connector sleeve, and (2) gripping jaws for gripping said portion not-to-be-crimped, said gripping jaws being slidably guided along the crimping jaws and being tensioned by springs.

2. The machine of claim 1 comprising a crimping-jaw-drive element and a gripping-jaw-drive element.

3. The machine of claim 2 comprising a stripping tool for stripping said cable end, said crimping-jaw-drive element being connected to drive said crimping jaws and said stripping tool.

4. The machine of claim 3 wherein said stripping tool comprises a stripper-gripper for gripping said cable end, said stripper-gripper being connected to means for actuating said crimping jaws.

5. The machine of claim 1 comprising pressure cylinders connected to drive said gripping jaws and said crimping jaws.

6. The machine of claim 1 or claim 2 wherein said crimping jaws comprise a protruding tang and a cooperating groove.

7. The machine of claim 1 or claim 2 wherein said gripping jaws comprise a semi-circular groove.

8. The machine of claim 2 comprising a pressure monitor for measuring the pressure exerted by the crimping jaw on the crimpable connector sleeve.

9. The machine of claim 8 wherein said pressure monitor is connected to said crimping-jaw-drive element.

10. The machine of claim 9 wherein said pressure monitor comprises a switch operated by the crimping jaws.

11. The machine of claim 1 or claim 2 wherein the crimping-jaw-drive element comprises gripper levers movable with respect to one another, said gripper levers comprising said crimping jaws.

12. The machine of claim 1 or claim 2 comprising a tilt drive element for tilting said crimping jaws and said gripping jaws about an axis parallel to their crimping and gripping motion, said tilting being between a first position for receiving a connector from the connector feed means and a second position in which the jaws are parallel to the axis of the cable end inlet.

13. The machine of claim 12 wherein the tilt element comprises a pin eccentric with respect to said tilting axis on one crimping jaw and a reversing element integral with the housing and cooperating with said pin.

14. A machine according to claim 13 wherein the reversing element is a fork.

15. The machine of claim 12 wherein the crimping jaws are fastened to an articulating fork.

16. The machine of claim 1 or claim 2 comprising a means for stripping the cable end, said stripping means comprising a stripping tool, and said machine further comprises a swing drive element for swinging at least one of the stripping means and the crimping means against the cable inlet.

17. The machine of claim 16 wherein the swing drive element comprises a swingable frame.

18. A machine for fastening a connector to a cable end, the connector comprising a crimpable sleeve and a portion not to be crimped, the machine comprising (a) a stationary inlet to receive the cable end;
(b) means to feed separate individual connectors to the cable end;
(c) means for crimping said connector sleeve around said cable end, said crimping means comprising a crimping/mounting element having, (1) crimping jaws for crimping said connector sleeve, and (2) gripping jaws for gripping said portion not-to-be-crimped; and
(d) a tilt drive element for tilting said crimping jaws and said gripping jaws about an axis parallel to their crimping and gripping motion, said tilting being between a first position for receiving a connector from the connector feed means and a second position in which the jaws are parallel to the axis of the cable end inlet.

19. A machine for fastening a connector to a cable end, the connector comprising a crimpable sleeve adapted to surround the cable end, the machine comprising:

(a) a stationary inlet to receive the cable end;
(b) means to feed separate, individual connectors to the cable end;
(c) means to strip the cable end comprising a stripping tool;
(d) means to crimp the sleeve around the cable end comprising a crimping tool; and
(e) positioning means to position at least one of the stripping means and the crimping means against the cable inlet, said positioning means comprising a swing frame, at least part of the means to strip and at least part of the means to crimp being mounted to, supported by, and moved into their respective working positions by, the frame.

20. The machine of claim 19 wherein the swing frame is a swing-slide frame.

21. The machine of claim 19 wherein the swing frame is positioned to have its swing axis parallel to the axial direction of cable inlet.

22. The machine of claim 19 wherein the swing frame is positioned with its swing axis perpendicular to the axial direction of cable lead inlet.

23. The machine of claim 19 comprising a common drive element for the stripping tool and the crimping tool.

24. The machine of claim 23 wherein the common drive element is mounted outside the swing frame.

25. The machine of claim 24 wherein the common drive means is mounted in a slide frame supported by the swing frame.

26. The machine of claim 19 comprising a frame drive element is mounted in swing frame.

27. The machine of claim 26 wherein the common tool drive element and the frame drive element are each a pressure cylinder.

28. The machine of claim 19 comprising switches to detect movements and positions of the frame.

29. The machine of claim 28 wherein at least some of the switches are actuatable by frame drive elements.

30. The machine of claim 28 wherein one of the switches triggers the means to feed separate individual connectors.

31. The machine of claim 30 wherein one of the switches detects an end slide position of the slide frame.

32. The machine of claim 31 wherein one switch is triggered by a pressure cylinder.

33. The machine of claim 19 for fastening a connector comprising a plastic collar and a metal tubular portion.

* * * * *

UNITED STATES PATENT AND TRADEMARK OFFICE

CERTIFICATE OF CORRECTION

PATENT NO. : 4,730,384

DATED : March 15, 1988

INVENTOR(S) : Hans Frohlich

It is certified that error appears in the above-identified patent and that said Letters Patent are hereby corrected as shown below:

Column 1, lines 10-14, delete "The solution to this problem ... subclaims."

Column 5, line 12, delete "cable lead inlet 20:".

Column 6, line 18, "diametrally" should be -- diametrically --.

Column 7, line 40, "guide" should be "guided --.

Column 15, line 52 "opposited" should be -- opposite --.

Signed and Sealed this

Seventh Day of March, 1989

*Attest:*

DONALD J. QUIGG

*Attesting Officer*

*Commissioner of Patents and Trademarks*